United States Patent [19]

Robinson et al.

[11] 4,348,970

[45] Sep. 14, 1982

[54] SELF-OILING PORTABLE BAG-CLOSING SEWING MACHINE

[75] Inventors: Robert J. Robinson, North Oaks; David B. Johnson; Verdell H. Schroeder, both of Minneapolis, all of Minn.

[73] Assignee: Bliss & Laughlin Industries, Incorporated, Oak Brook, Ill.

[21] Appl. No.: 136,312

[22] Filed: Apr. 1, 1980

[51] Int. Cl.[3] ..... D05B 71/00

[52] U.S. Cl. ..... 112/256; 112/11; 112/169; 112/288

[58] Field of Search ..... 112/256, 10, 11, 169, 112/288

[56] References Cited

U.S. PATENT DOCUMENTS

| | | | |
|---|---|---|---|
| 2,848,967 | 8/1958 | Nicolay | 112/256 |
| 3,094,955 | 6/1963 | Fischbein et al. | 112/169 X |
| 3,418,955 | 12/1968 | Attwood et al. | 112/256 |
| 3,478,709 | 11/1969 | Fischbein et al. | 112/11 X |
| 3,716,007 | 2/1973 | Fischbein et al. | 112/11 |
| 3,771,478 | 11/1973 | Tranguilla et al. | 112/256 |

*Primary Examiner*—H. Hampton Hunter

*Attorney, Agent, or Firm*—Williamson, Bains, Moore & Hansen

[57] ABSTRACT

A portable bag-closing sewing machine is provided with a self-oiling system which includes an oil reservoir connected to the machine and oil-delivery means to direct oil from the reservoir into the inner chambers of the machine where oil is distributed by gravity flow, capillary action and movement of machine components, the oil moving along through the machine components and through a series of channels, troughs, and reservoirs within the housing to distribute oil throughout the machine. During operation, the rotating and reciprocating machine parts fling oil outwardly within the chambers to directly oil machine assemblies and to create a fine mist of oil throughout the chambers so as to further lubricate machine components. Also disclosed is an improved and self-lubricating feed dog assembly and thread chain cutting device.

33 Claims, 25 Drawing Figures

98
102
128
126
130
132
28
24
23
134
133
136
5
120
92
104
30
26
34
36
12
432
148
140
5
138
142
137
139
8
8
450
143
146
448
144
240
145
454
458
247
250
236
176
11
11
452
238
254
455
246
252
242
244
244
460
456
262
256
258
257
259
460
106
302
304
290
464
287
288
254
308
272
462
322
320
464
426
358
406
326
360
314
312
560
316
346
400
348
234
388
260
392
350
338
340
336
476

247
176
244
102
248
251
242

508
180
12
206
212
216
214
208
213
210
220
218
204
222

150
162
144
139
152
137
474
138
141
146
102

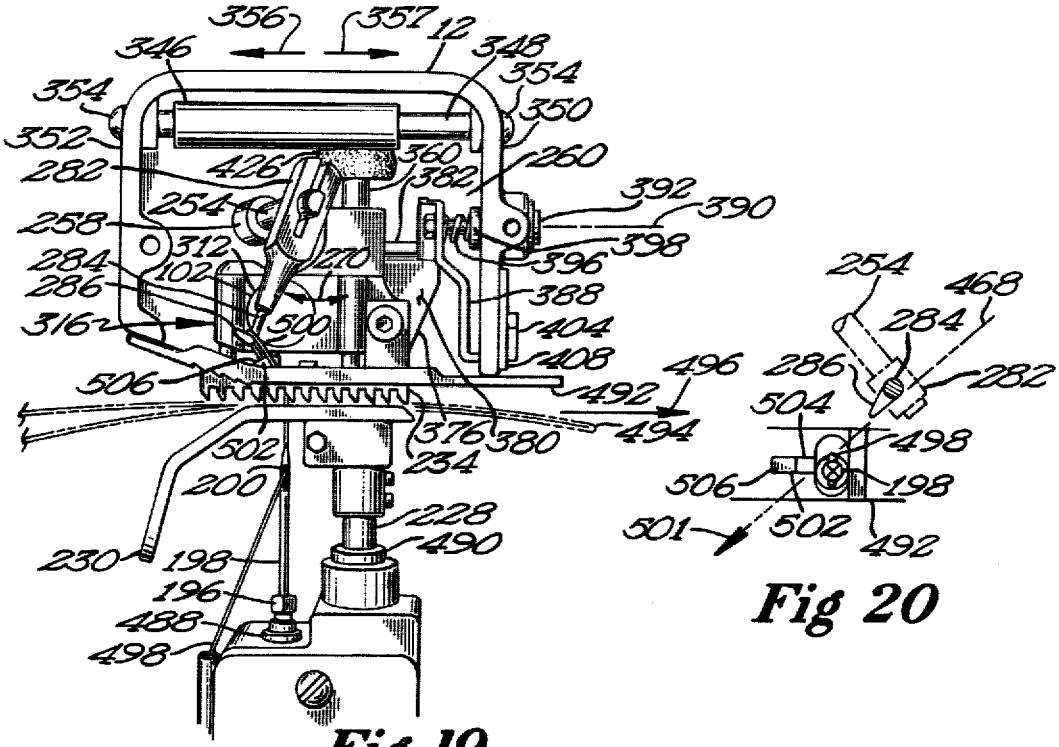
Fig 20
Fig 19
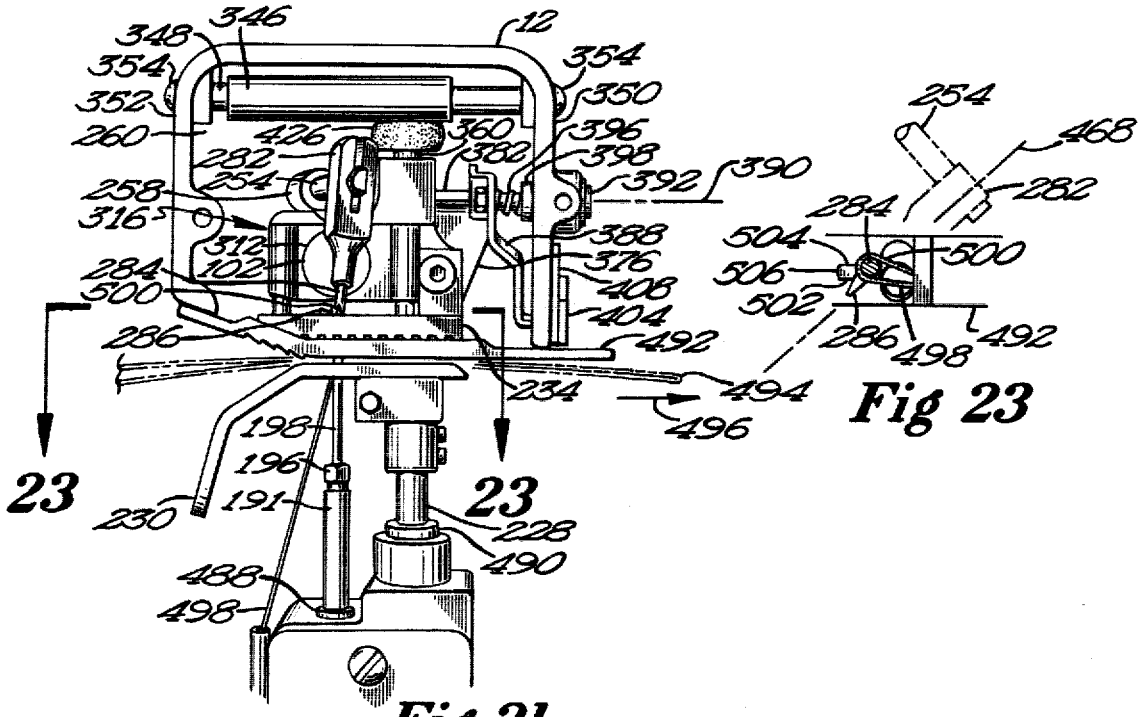
Fig 23
Fig 21

SELF-OILING PORTABLE BAG-CLOSING SEWING MACHINE

BACKGROUND OF THE INVENTION

The present invention disclosed herein relates to the field of portable bag closing sewing machines and comprises an improved portable machine with a highly reliable self-oiling system which provides essential lubrication for the machine and requires minimal attention by an operator.

Many manufacturing facilities produce products which are granular, fibrous, or are in other ways suitable for storage in bags or sacks and require packaging machinery able to stitch closed the top of such open-topped bags or sacks. In many packaging applications it is desirable to use small, hand-held, portable bag-closing sewing machines like that disclosed in U.S. Pat. No. 3,094,955, and such machines are particularly necessary in packaging situations where the sack or bag flow is not continuous or where large and heavy stationary machines and moving conveyor belts are not practical or available. Such portable machines, to be practical and commercially accepted, must be lightweight, easy to handle, highly reliable, resistant to jamming or failure, simple to operate, and easy to lubricate.

Regular lubrication of these portable bag-closing sewing machines is essential since such machines are commonly utilized in packaging products which are dusty and abrasive, such as powders, fertilizers, mineral products, foods, and the like. In some applications such portable machines may see almost round-the-clock duty in assembly line or shipping dock environments and they commonly are subjected to heavy use in dusty and abrasive environments abusive to mechanical movements, making regular lubrication critical to uninterrupted operation.

The requirement of regular lubrication has been recognized and provided in the field of larger, heavier, stationary bag-closing machines where the weight and complexity of an added self-lubrication system do not pose a problem to commercial acceptance. For example, U.S. Pat. No. 3,478,709 discloses a stationary bag-closing machine with a highly efficient internal lubrication system utilizing a series of tubes, manifolds and a continuous duty pump to move oil to all interval parts of a sealed sewing machine unit. Despite the need for a self-lubricated portable bag-closing sewing machine, prior to the present invention no portable machine had been successfully equipped with a self-lubricating system which was sufficiently lightweight, simple and reliable as to be commercially acceptable. Prior to the present invention, portable bag-closing machines were lubricated by means of either disassembling the housing of the machine to dispense oil or lubricant on appropriate moving parts or, alternatively, lubricating the components through approximately a dozen or more external nipples or oiling locations. While existing machines without self-lubrication features function extremely well and provide long life when given proper care, it has been found that for various reasons, many of the machines do not receive required lubrication and go untended until the machine fails.

Because operation of most portable bag-closing machines is a simple, easily understood task, operation is commonly assigned to unskilled, newly-hired employees who often do not appreciate the importance of regular oiling of the portable machine. Consequently, a machine which might otherwise last for years often fails prematurely because of the abrasive environment in which it functions and the sometimes total lack of oiling and lubrication.

It is thus desirable to provide a portable bag-closing sewing machine which is capable of self-lubrication from a simple oil reservoir, which does not become unnecessarily complex or expensive, which does not require extensive internal tubing or added pumping devices which add significant weight or bulk to the machine. The present invention accomplishes these goals.

SUMMARY OF THE INVENTION

The invention comprises a portable bag-closing sewing machine having a self-oiling system the structure of which utilizes a variety of different oil distribution techniques including gravity flow, centrifugal flinging of oil, depositing of oil from an oil mist within the machine, capillary action, and storing of oil in wicking and porous gaskets for subsequent release to moving parts as needed. The cooperation of these numerous techniques of oiling in a portable bag-closing machine assures reliable distribution of the oil to all moving parts within the machine and increases the useful life of the machine substantially, solving the long-standing problem of failure of portable machines due to inadequate lubrication.

The invention carries an easily visible, external oil reservoir whose level may be inspected by casual observation and which contains oil for metered feeding into the drive train chamber of the machine through a metering valve.

Oil enters the drive train chamber of the machine by first flowing through the upper main drive shaft bearing which is provided with a channel means which in combination with the bearing and the rotating drive shaft establishes a pumping action in the bearing which provides excellent lubrication to the bearing and assures an even flow of oil entering the drive train chamber positioned below the bearing.

Oil introduced to the drive train chamber is received on a rotating eccentric collar and a similarly rotating looper cam which turn at high velocities to fling the oil droplets thereon outwardly against the interior walls of the drive train chamber to shatter the droplets against the walls and create a mist of oil throughout the drive train chamber. Much of the oil thrown outwardly from the collar and the looper cam is also showered on the various moving components positioned within the drive train chamber to provide direct lubrication to such components.

A variety of oil channels, wicking, oil accumulation troughs and the like direct oil throughout the drive train chamber so as to lubricate all moving parts and bearing surfaces therein.

Oil thus dispersed within the drive train chamber eventually reaches the bottom of such chamber and is then directed to the feed dog chamber which is positioned in the housing beneath the drive train chamber. Such oil is then distributed throughout the feed dog chamber by a combination of gravity flow and by the establishing of a mist of oil in the feed dog chamber by outward flinging of oil drops by a rapidly moving feed dog block.

An improved thread chain cutting device is provided for use with the feed dog block and is particularly well adapted to the utilization of oil from the feed dog block to lubricate the moving parts associated with the thread chain cutting device.

Beside having specific utility in the bag-closing field, the portable self-oiling sewing machine is useful in many other fields in which materials, mats or fabrics must be joined and such fields often involve working environments in which regular lubrication is essential to the sewing machine. Accordingly the need for a self-oiling sewing machine such as that described herein extends well beyond the bag-closing art.

These and other advantages of the invention will appear from the following drawings and detailed description in which like parts carry identical numbering in the several views.

BRIEF DESCRIPTION OF THE DRAWINGS

FIG. 19 is a bottom view of the feed dog chamber of the sewing machine of FIG. 1 and showing the interaction of the feed dog assembly, the looper assembly, the needle driving assembly, and the thread chain cutting assembly.

FIG. 20 is a side view taken in the direction of cutting plane 20—20 of FIG. 14 and showing the path of the looper and the interaction between the looper assembly and the needle.

FIG. 21 is a bottom view of the feed dog chamber illustrating the operation of the feed dog, looper, needle driving and thread cutting assemblies.

FIG. 23 is a side view of the looper and its interaction with the needle and the thread and is taken in the direction of cutting plane 23—23 of FIG. 21.

DESCRIPTION OF THE PREFERRED EMBODIMENTS

Figure 1:
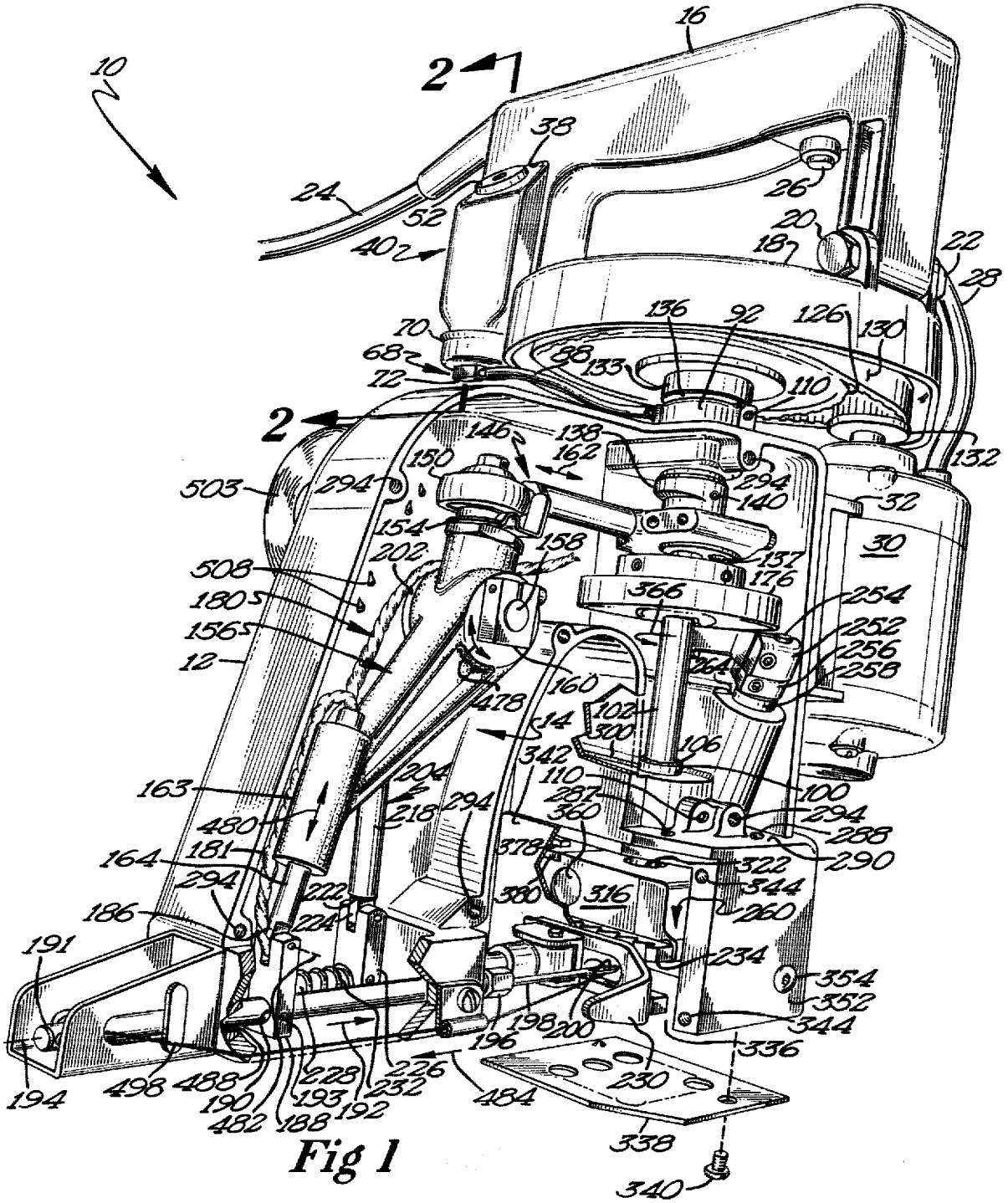
FIG. 1 is a front perspective view of a self-oiling portable bag-closing sewing machine taken partially in section and with the front cover removed to better show the interior of the drive train chamber.

Referring now to FIG. 1, a self-oiling portable bag closing sewing machine 10 utilizes a rigid protective housing 12 which is provided with a hollow, generally U-shaped, internal drive train chamber 14 and a feed dog chamber 260. The housing 12 also includes appropriate cover plates 292, 342 and 338. The housing 12 further includes a handle means 16 at the top of the machine 10 and a rigid guard 18 affixed to the handle 16 by bolt 20 and nut 22 to protect an operator from accidental entanglement in the gear 126 described hereafter.

Figures 7, 8, 10, 11:
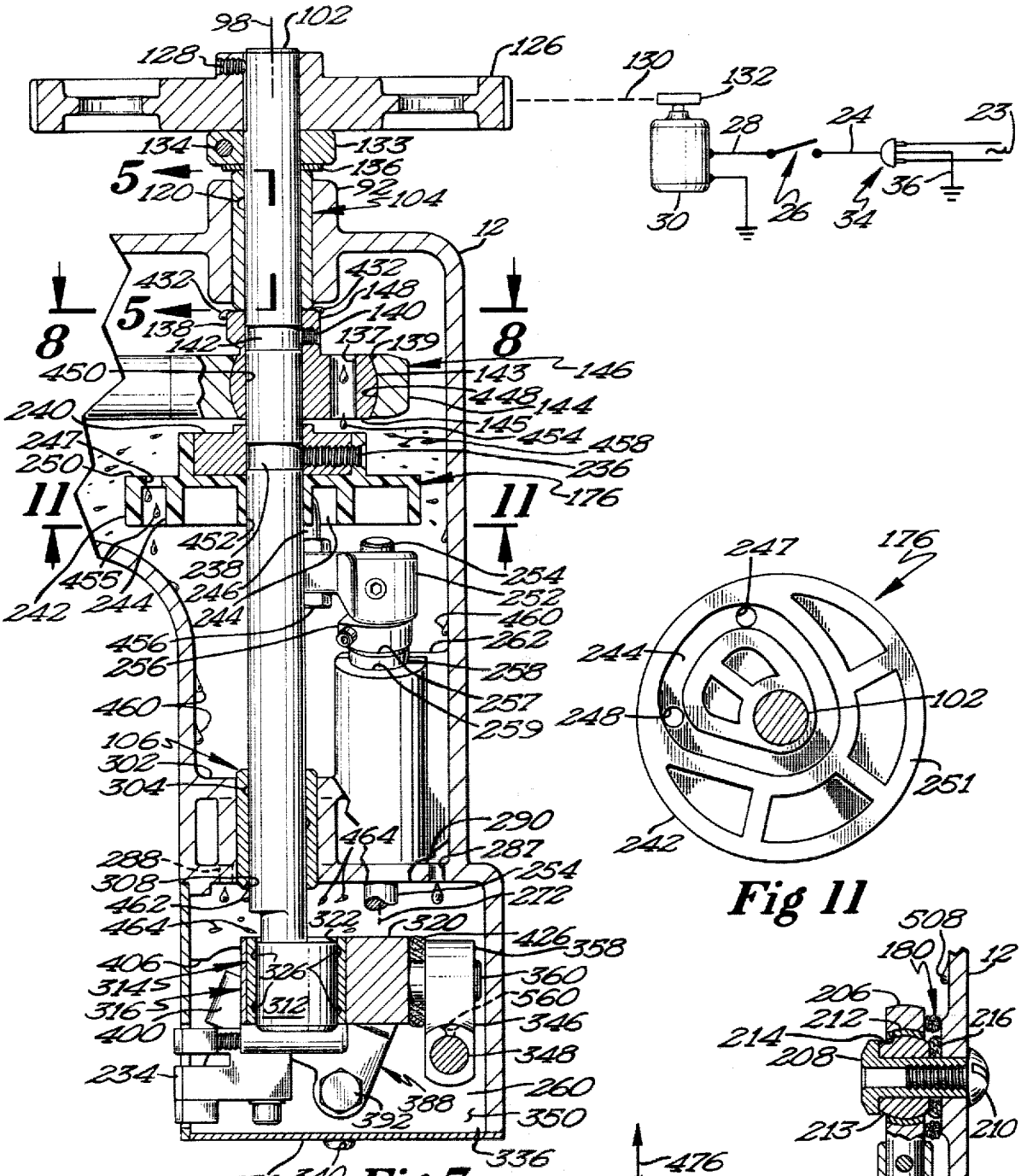
FIG. 7 is a front cross-sectional view of a portion of the drive train and feed dog chambers of the sewing machine of FIG. 1.
FIG. 8 is a top cross-sectional view of the eccentric collar and connecting rod taken in the direction of cutting plane 8—8 of FIG. 7.
FIG. 10 is a cross-sectional view taken in the direction of cutting plane 10—10 of FIG. 9 and showing structure by which the pressure foot unit is lubricated.
FIG. 11 is a bottom view of the looper cam taken in the direction of cutting plane 11—11 of FIG. 7.

Referring now to FIGS. 1 and 7, an electrical power cord 24 enters the handle 16 and is operatively electrically connected with push button switch 26 which when depressed by an operator may be used to close a circuit permitting electrical current to flow from a power source 23 to the power cord 24, through switch 26, along cord 28 to motor 30 which is securely mounted to the housing 12 by means of bracket 32. The motor and housing 30 and 12, respectively, are preferably grounded as is well known to the art by use of a three-pronged plug 34 having a ground connection 36. Alternatively, a double insulated case may be employed as is also well known to those skilled in the art.

Figure 2:
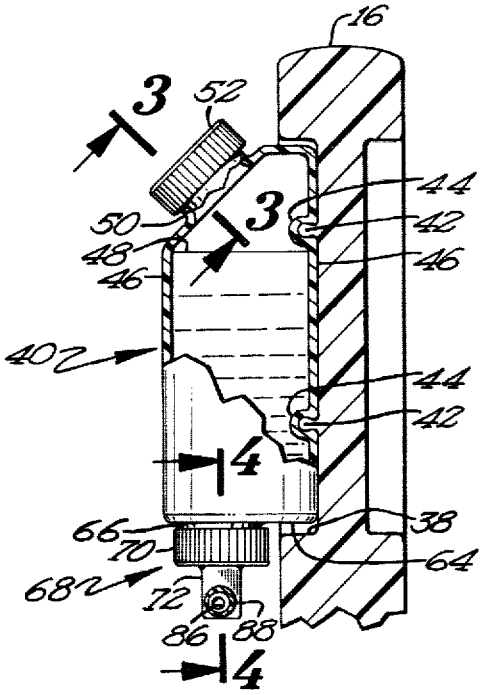
FIG. 2 is a cross-sectional view through the oil reservoir of the machine taken in the direction of cutting plane 2—2 of FIG. 1.

The handle 16 is preferably provided with a recessed slot 38 as best shown in FIGS. 1 and 2 so as to provide an out-of-the-way place for positioning and carrying an easily visible and inspectable oil reservoir 40. While the reservoir 40 may be attached to or carried by the housing 12 in any known way, the reservoir is here shown as being detachably mounted to the handle 16 by means of a plurality of studs 42 which extend outwardly from handle 16 and are closely engaged and received in cooperating sockets 44 formed in the side wall 46 of reservoir 40.

Figure 3:
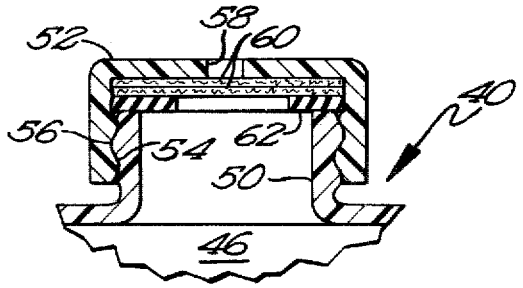
FIG. 3 is a cross-sectional view through the closure cap of the oil reservior of the machine taken in the direction of cutting plane 3—3 of FIG. 2.

Preferably the oil reservoir 40 is formed of a plastic-like material which is reasonably resistant to breakage and rough handling and impervious to the long-term storage of oil 48 within the container. Additionally it is advisable that the container be of a transparent or translucent character so that the oil level may be observed without opening the container. Referring now to FIG. 3, the reservoir 40 is provided with a readily accessible outwardly-facing filling aperture 50 which may be selectively, tightly closed by means of closure cap 52 which is provided with internal threads 54 for engagement with the external threads 56 of the aperture 50. The filler cap 52 has a venting aperture 58 extending through the cap top and confronting one or more layers of thin filter material 60. An annular fluid-tight gasket 62 is positioned within the cap 52 to facilitate tight sealing between cap 52 and aperture 50 when the cap is securely attached. Filter material 60 prevents entry of unwanted dirt and other extraneous contaminating material into the oil reservoir 40. While a specific embodiment 52 of a closure cap with specific venting means has been disclosed, it should be understood that any other closure means known to the art by which oil may be retained in the container and clean air may be admitted to the oil reservoir so as to permit normal outward flow of oil from an outlet 66 and into the sewing machine as will be disclosed hereafter, may be substituted and is within the purview of the invention.

Figure 4:
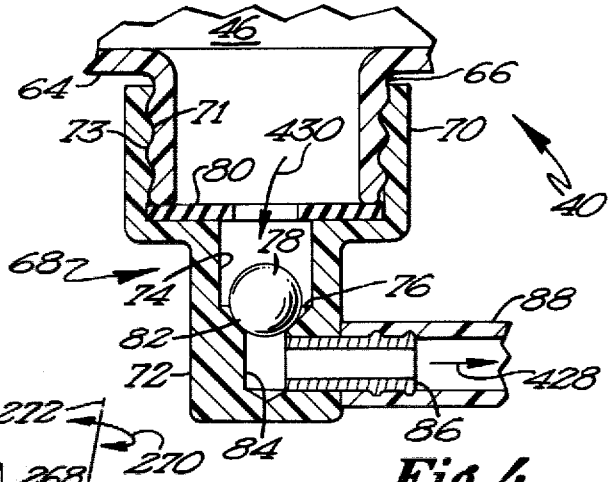
FIG. 4 is a cross-sectional view of an oil flow control valve used with the machine and taken in the direction of cutting plane 4—4 of FIG. 2.

Referring now to FIGS. 2 and 4, the bottom 64 of the reservoir 40 has a threaded outlet aperture 66 to which an oil metering valve 68 is threadably attached. The valve 68 may be a ball check valve and includes a screw-on cap 70 in which internal thread 71 engages the external thread 73 of the outlet 66. The valve 68 has an integral valve casing 72 with an internal cylindrical ball chamber 74 at the base of which is a downwardly tapered, conical valve seat 76. A movable valve ball 78 is retained within the chamber 74 by a gasket 80 which is held in place by annular detent means in the cap 70, the ball being movable between a closed position 82 as shown in FIG. 4 wherein oil flow from the reservoir 40 cannot pass the ball 78 and flow to exit chamber 84 and an open position (not shown) wherein the ball 78 does not fully obstruct the valve seat 76 and oil may flow from chamber 74 to chamber 84 so as to introduce oil into the sewing machine 10 as will be described further hereafter.

The ball check valve 68 prevents excessive oil flow from reservoir 40 to the machine 10 and when the machine is in the normal, upright operating position shown in FIG. 1, the valve 68 is in closed position 82 and little oil enters the chamber 14 of the machine. However, when the machine is lifted by an operator, swung during carrying, or manipulated during sewing as would be the case during normal stitching or thread chain cutting functions, the ball 78 is intermittently dislodged from its valve seat 76 and oil is released downwardly to exit chamber 84 for subsequent entry into the sewing machine 10. In addition to the described occasions under which the ball 78 moves to an open position to permit oil flow, vibration of the machine during normal operation can also cause dislodgement of the ball 78 from seat 76 and encourages a slow, metered flow of oil from the reservoir 40 into the machine.

While the shown valve of FIG. 4 utilizes a structure in which the pressure of the oil in the container is applied downwardly on the ball 78, it should be understood that numerous other valve configurations are within the purview of the invention. For example it has also been found acceptable to utilize a structure where oil pressure from the reservoir is exerted on the ball 78 from below to intermittently raise the ball in response to machine vibration, manual swinging of the machine and the like.

A nipple 86 extends outwardly from the valve casing 72 and communicates with exit chamber 84. A flexible connecting tube or hose 88 fits tightly over the nipple 86 to direct oil flow from the valve 68 to a second nipple 90 (FIG. 5) which is threaded into boss 92 of housing 12.

Figure 5:
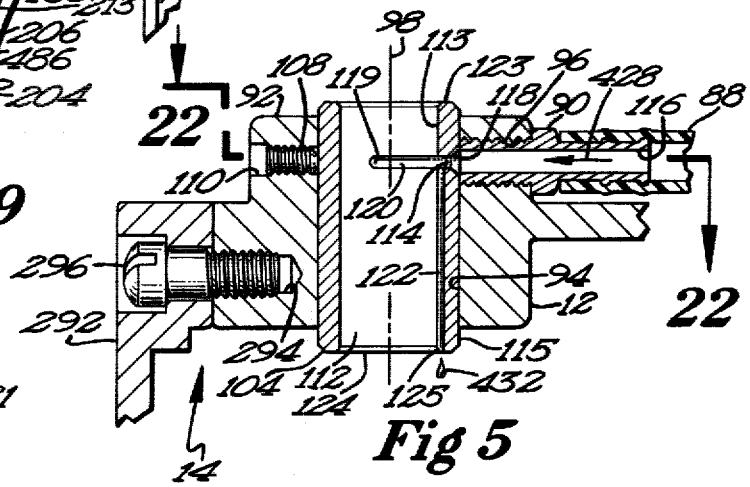
FIG. 5 is a cross-sectional view of a portion of the housing and showing the upper main drive shaft bearing of the machine, the view being taken in the direction of cutting plane 5—5 of FIG. 7, described hereafter.

The boss 92 is cast as an integral part of the housing 12 and has a generally cylindrical configuration with a bearing aperture 94 bored axially therealong as best shown in FIG. 5. The nipple 90 is threadably received in threaded oil delivery bore 96 which communicates with the aperture 94, permitting oil flow from the hose 88 to the aperture 94. The aperture 94 has a central longitudinal axis 98, and a second bearing aperture 100 (FIG. 1) is positioned coaxially with the aperture 94 so that apertures 94 and 100 can receive coaxially aligned first and second main drive shaft bearings 104 and 106, respectively, which rotatably journal generally upright main drive shaft 102.

The upper and lower main drive shaft bearings 104 and 106, respectively, are retained within apertures 94 and 100, respectively, by one or more set screws 108 received within threaded apertures 110 as best shown in FIGS. 1 and 5. Accordingly, the bearings 104 and 106 are positioned to have a common central longitudinal axis 98 and rotatably receive main drive shaft 102 therein and retain the drive shaft in the shown upright orientation of FIG. 1.

Figure 6:
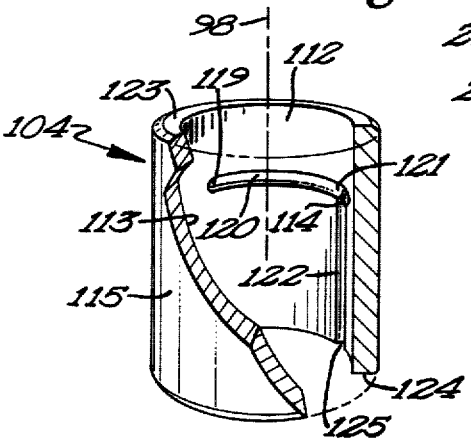
FIG. 6 is a perspective, partially cut away view of the upper main drive shaft bearing used with the machine.

Referring now to FIGS. 5–7, upper main drive shaft bearing 104 is cylindrical in configuration with a central longitudinal aperture 112 in which main drive shaft 102 is received. The bearing 104 has an oil port 114 extending radially outwardly therethrough from inner periphery 113 to outer periphery 115, and the bearing 104 is oriented so that port 114 communicates with centrally positioned opening 116 of nipple 90. Preferably the oil port 114 has an outer countersink 118 (FIG. 5) to simplify alignment between port 114 and opening 116.

Referring now to FIG. 6, integral, one-piece bearing 104 has upper and lower ends 123 and 124, respectively, and is provided with a generally horizontal laterally extending channel 120 which is substantially parallel to a plane oriented perpendicularly to the central axis 98 of the bearing 104.

The horizontal channel 120 is cut into the inner periphery 113 of bearing 104 so as to move oil laterally of the oil port 114 and communicates with the oil port 114, the channel 120 having first and second lateral extremities 119 and 121, repectively. A generally upright channel 122 extends from oil port 114 to its exit 125 at the lower end 124 of the bearing. The purpose and operation of channels 120 and 122 which collectively comprise an oil channel means for directing oil to the drive train chamber, will be described further hereafter.

The valve 68, hose 88, nipple 90, oil delivery bore 96, oil port 114, and the channels 120 and 122 collectively comprise one type of oil delivery means for directing oil from oil reservoir 40 to a location within the machine where oil can eventually work its way downwardly into drive train chamber 14, as will be further described hereafter.

Referring next to FIGS. 1 and 7, a pulley wheel 126 is rigidly attached to the main drive shaft 102 at the upper end thereof by any known means such as one or more set screws 128 so that pulley wheel 126 rotates with drive shaft 102. A timing belt 130 extends about the outer rim of pulley wheel 126 and to and around pulley 132 which is affixed to the shaft of motor 30. The motor 30, pulleys 132 and 126, timing belt 130 and main drive shaft 102 collectively comprise a driving means for rotating the main drive shaft when motor 30 is energized.

A split collar 133 (FIGS. 1 and 7) is rigidly secured to drive shaft 102 by tightening screw 134 and provides a convenient device for adjusting the degree of permitted end play of shaft 102. A thrust washer 136 is positioned immediately beneathr split collar 133 and contacts the upper end 123 of bearing 104 to assure that any rough edges of split collar 133 will not cut or wear down the bearing 104.

Referring again to FIGS. 1 and 7, a needle drive eccentric collar 138 is rigidly attached to the drive shaft 102 adjacent bearing 104 by set screw 140 which is received in annular recess 142 of shaft 102. The eccentric 138 is rotatably received in a first end 144 (FIGS. 7 and 8) of needle drive connecting rod 146 and has a projection 148 which extends upwardly from the connecting rod and along shaft 102.

Referring now to FIGS. 1 and 8, connecting rod 146 has a second end 150 which is provided with a universal mounting 152, the mounting 152 receiving a first end 154 of needle drive lever 156 which is swingably mounted for reciprocating rocking movement in directions 478 about post 158 when rotation of shaft 102 causes rod 146 to move reciprocatingly in directions 162. The post 158 is fixed to the housing 12 and extends outwardly from it in cantilever fashion. The needle drive lever 156 is retained on post 158 by split collar clamp 160.

An annular oil accumulation groove 139 between rotating collar 138 and connecting rod 146 tends to accumulate oil dropping on the top 141 of the eccentric and guides it into the outer periphery 143 of the eccentric collar so as to insure adequate lubrication between the collar and the connecting rod. One or more oil bores 137 are formed in the eccentric collar 138 and extend from the upper surface 141 to the lower surface 145, the two shown oil bores serving to pass oil by gravity flow from the upper surface 141 to the lower surface 145 of the collar 138 to insure some downward movement of oil adjacent shaft 102.

Rotation of eccentric collar 138 tends to urge any oil thereon outwardly from the shaft 102 and flings such oil radially outwardly against the interior walls of the drive train chamber and directly onto universal joint 152 to provide needed lubrication of the universal joint. Oil 458 flung rapidly outwardly from the rotating eccentric showers the moving components within the chamber 14 and is also hurled at the interior walls of the drive train chamber 14 and on striking the walls is substantially fragmented into a multiplicity of fine droplets so as to create a mist of oil within the drive train chamber as illustrated in FIG. 9.

Figure 9:
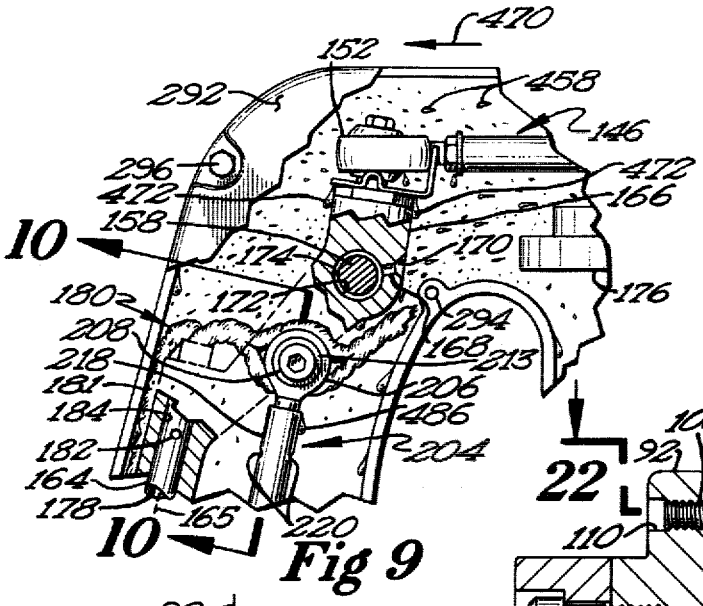
FIG. 9 is a front view of a portion of the drive train chamber of the sewing machine of FIG. 1 and taken partially in section and phantom to show the manner in which a part of the needle driving assembly is constructed and lubricated and to display a portion of the presser foot unit and the structure for its lubrication.

Referring now to FIGS. 1 and 9, the needle lever 156 has its second end 162 provided with an elongated section or sleeve 162 having an elongated interior bearing aperture 184 which slidably receives longitudinal shaft 164 therealong. The side 166 of needle drive lever 156 has an oil port 168 formed therein and which is countersunk at 170 to provide a larger opening for receiving of oil as will be described further hereafter. The internal bearing surface 172 of the needle drive lever 156 has an annular slot 174 which closely confronts the post 158 and communicates with the oil port 168 so that oil introduced into the port 168 reaches the annular slot 174 to provide lubrication to the bearing surface 172 and the post 158. The countersink 170 is positioned adjacent and confronting the drive shaft 102, collar 138, and cam 176 connected thereto, so that oil 458 flung radially outwardly by the rotating cam 176 and collar 138, as will be described further hereafter, showers the needle drive lever 156, pentrates directly into the countersink 170 or lands on the lever 156 so that accumulating droplets above the countersink 170 will run into the countersink and thereby reach the annular slot 174.

Referring again to FIGS. 1 and 9, the longitudinal shaft 164 has a central axis 165 and a hollow axial passage 178 into which a length of oil-transmitting wicking 180 is inserted with a long trailing wicking section 181 extending to clamp 188. The wicking 180 which extends outwardly from the hollow interior passage 178 of longitudinal shaft 164 extends downwardly and is wrapped about the lower end 186 of shaft 164 and between the bifurcations of clamp 188 so that oil from the wicking lubricates the pivotal mounting between the shaft 164 and clamp 188 and may also work its way downward by gravity flow to shaft 191. The wicking 180 is a fibrous oil-absorbing medium which readily collects oil from within the drive train chamber 14 and transmits it along the fibrous wicking so that oil may be spread outwardly along the wicking and transferred to various components, a concept well known to the art.

The longitudinal shaft 164 is provided with one or more radial oil ports 182 which pass through the cylindrical wall of the shaft 164 so that oil delivered within its axial passage 178 is released outwardly through the ports 182 and consequently is applied to the interior bearing aperture 184 of the sleeve 163, assuring adequate lubrication between the shaft 164 and elongated section 163.

The lower end 186 of shaft 164 is pivotally mounted to a bifurcated clamp 188 (FIG. 1), the clamp 188 having a bore 190 through which is passed needle drive shaft 191 A set screw 193 securely attaches the clamp 188 to the needle drive shaft 192 so that rocking movement of the needle drive lever 156 about pivot post 158 causes the needle drive shaft 191 to be slidably moved in directions 192 and 484 along its axis 194 and through bearings 488 (FIGS. 1 and 19). The longitudinal shaft 164 and bifurcated clamp 188 collectively comprise a needle bar clamp which is useful in converting rocking motion of needle lever 156 to the axial sliding motion required of needle drive shaft 191. A needle chuck 196 is provided at one end of the shaft 191 to receive and retain a heavy duty sewing needle 198 having a thread aperture 200. It is desirable to lubricate the bearings 488 through which the needle drive shaft slides and such lubrication is accomplished by oil drops or mist falling from above onto the shaft 191 and then being introduced into the bearings 488.

The eccentric collar 138, connecting rod 146, needle drive lever 156 swingably retained on pivot post 158, longitudinal shaft 164, bifurcated clamp 188, and slidably mounted needle drive shaft 191 and its associated chuck 196 and needle 198 collectively comprise a needle driving assembly usable with the portable bag closing machine.

The wicking 180 which was described earlier in conjunction with the longitudinal shaft 164 is also twisted about the pivot post 158 to assist in oil being supplied to the interface 202 (FIG. 1) formed between the needle drive lever 156 and the annular surface of the housing 12 immediately surrounding the post 158. Referring now to FIGS. 1 and 9, additional oil reaches the interface 202 from downward flow of oil 508 along the interior wall of the chamber 14 and by outward spraying of oil 458 from cam 176 and collar 138. The oil mist generated during operation of the machine provides further oil accumulation in this region.

Referring now to FIGS. 1, 9 and 10, a presser foot lifter lever 204 has its upper end 206 swingably mounted to a cantilevered post 208 which is retained to the housing 12 by screw 210. A bearing 212 is interposed between an aperture 214 of the lifter lever and the post 208, and an oil-absorbing felt washer 216 is positioned between the housing and self-aligning insert 213 of the lifter lever. Wicking 180 is twisted about the cantilevered post 208 in close proximity to the upper end 206 and to the felt washer 216 so that oil from the wicking will impregnate the felt washer and transfer such oil to the bearing. The bearing 212 also obtains oil from droplets 508 running down the wall of housing 12 and from oil 458 sprayed from the cam 176 and collar 138. The presence of the oil mist within the chamber 14 during operation assures further oil deposit on the post 208, wicking 180 and washer 216.

The lifter lever 204 has a downwardly extending hollow longitudinal shaft 218 which is provided with oil ports 220 passing diametrically entirely through the wall of the hollow shaft 218 at opposed peripheral sides of the shaft 218 so that oil running down the outer periphery of the shaft 218 will find its way into the ports 220 so as to lubricate the inner periphery of shaft 218. A rod 222 is received within the hollow shaft 218 for telescoping sliding movement into and out of the hollow shaft 218. The presence of oil ports 220 assures adequate lubrication within the hollow shaft 218 so that sliding rod 222 moves freely therein.

The lower end 224 of the rod 222 is pivotally mounted to bifurcated clamp 226 which in turn is rigidly clamped to presser foot shaft 228. Presser foot shaft 228 is mounted for sliding movement along its longitudinal axis by a pair of bearings like those used for needle shaft 191 and carries presser foot 230. A coil spring 232 is carried on shaft 228 and is interposed between the housing 12 and the bifurcated clamp 226 to urge the presser foot shaft in the direction 192 and bias the presser foot 230 firmly against throat plate 342 for interaction with feed dog 234.

The lifter lever 204, post 208, telescoping rod 222, bifurcated clamp 226 which pivotally receives rod 222, slidably mounted presser foot shaft 228, presser foot 230, and spring 232 collectively comprise a presser foot unit for retaining a bag between the presser foot 230 and the feed dog 234 during operation of the machine.

Referring now to FIGS. 1 and 7, a substantially circular looper cam 176 is rigidly retained to the shaft 102 by one or more set screws 236 which bear against a recessed portion 238 of the shaft 102 so that cam 176 rotates with shaft 102 and at the same angular velocity. Cam 176 has an upwardly extending cap 240 which is positioned directly beneath oil bores 137 of eccentric collar 138 and receives oil therefrom by gravity flow so that during normal rotational motion of the cam 176 such oil may be flung radially outwardly from the cam as best shown in FIG. 9 so as to cause the oil droplets to shower other components within chamber 14 and to strike the interior walls of the drive train chamber 14 and shatter against such walls in order to substantially fragment the oil droplets and form a mist of oil throughout the drive train chamber. This oil mist spreads to all parts of the chamber 14 and tends to work its way into the joints and bearing surfaces in the drive train chamber and is deposited on the various moving parts and shafts to provide needed lubrication throughout the chamber. It should be understood that the entire cam 176 and not merely the cap 240 participates in flinging oil radially outwardly, and it will be appreciated by those skilled in the art that as the machine 10 is actuated, the speed of the shaft 102 will gradually increase from zero to its normal operation speed of approximately 1,000 to 1,500 revolutions per minute and at stoppage will gradually decrease to a zero speed. During the changes in speed occasioned by stopping and starting, the angular velocity of the cam 176 and, of course, the eccentric 138 changes and accordingly the centrifugal force generated and applied to the oil by eccentric and cam varies and causes the oil in some cases to be thrown almost horizontaly outwardly and, in other cases, when the angular velocity is lower, to be flung in a more downwardly curving trajectory. The result of these speed variations is that the outwardly flung oil does not always follow the same trajectory and, much like a garden sprinkler, the path of the oil droplets is closely dependent on the force with which the droplets are thrown outwardly. This variation in velocity causes the droplets to be flung over a larger area with the droplets falling more sharply downwardly at slow speed and being thrown almost horizontally outwardly at high speed.

Referring now to FIGS. 7 and 11, the looper cam 176 has a lower, larger diameter section 242 with upper and lower faces 250 and 251, respectively, a continuous cam follower slot 244 being formed in lower face 251 to slidably receive a cam follower 246. Oil flow holes 247 and 248 pass vertically through the section 242 extending from the upper face 250 downwardly and directly into the cam follower slot 244 so that oil is delivered to the slot to provide needed lubrication between the slot and the cam follower 246.

Figure 12:
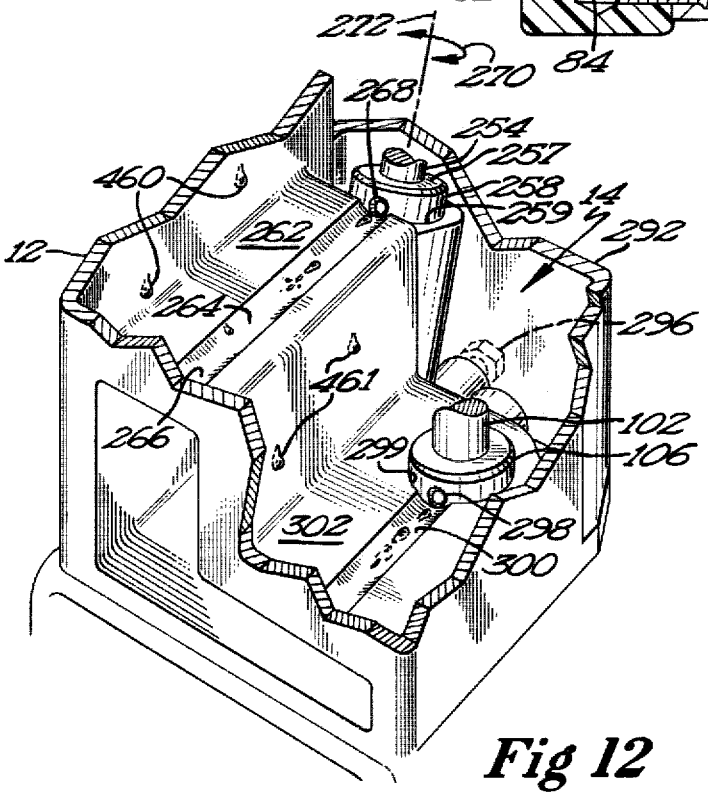
FIG. 12 is a rear perspective view of a lower portion of the drive train chamber of the sewing machine of FIG. 1 and wherein the housing of the machine is partially cut away.

Referring now to FIGS. 1, 7 and 12, the cam follower 246 is supported in and extends upwardly from cam follower arm 252 which is rigidly clamped to looper shaft 254 for movement with the shaft 254. A split collar 256 is interposed between the lower surface of follower arm 252 and the upper end 257 of looper shaft bearing 258. A second split collar (not shown) is clamped to the looper shaft 254 adjacent the lower end 280 of the looper bearing 258 and above looper holder 282 to limit axial movement of the looper shaft.

The looper shaft bearing 258 is received within an elongated looper shaft aperture 259 in the housing 12 and has its longitudinal axis 272 generally skew to the axis 98 of shaft 102. The aperture 259 extends from chamber 14 into the feed dog chamber 260.

Because the cam follower arm 252 oscillates through an arc 270 in response to rotation of the looper cam 176, it is desirable to provide adequate lubrication between the looper bearing 258 and looper shaft 254. Referring now to FIG. 12, the drive train chamber 14 within housing 12 has a generally horizontal, raised shelf 262 positioned rearwardly of looper bearing 258 and adjoining interior walls of the drive train chamber 14 so that oil 460 flowing down the interior walls of chamber 14 will reach shelf 262. A looper shaft oil accumulation trough 264 is formed in the shelf 262 and is inclined downwardly from end 266 toward the looper bearing 258, the trough 264 terminating against the bearing 258 with the bearing confronting and obstructing the lower end of the trough 264.

The looper bearing 258 has an oil port 268 which directly confronts and communicates with the trough 264 and extends between outer and inner peripheries 263 and 276, respectively, of the bearing so that oil accumulating within trough 264 flows downwardly into the oil port 268 and into bearing 258.

Figure 13:
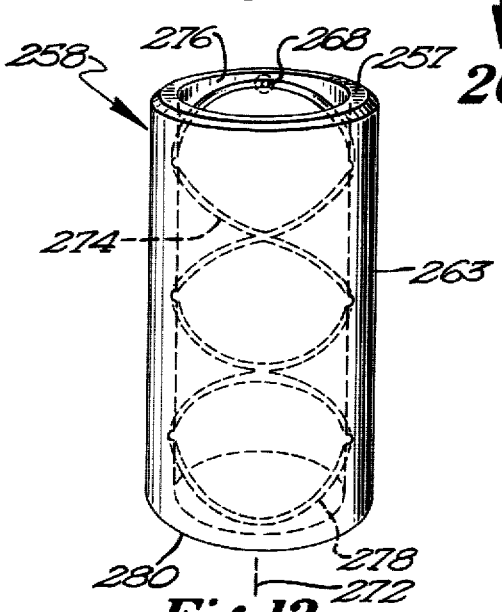
FIG. 13 is a perspective view of the looper shaft bearing in which an interior oil transmission channel is shown partially in phantom.

Referring next to FIG. 13, the looper shaft bearing 258 is provided with a continuous oil channel means 274 which extends entirely about the inner periphery 276 of the bearing and communicates with oil port 268. The three loops of the figure-eight type oil circulation channel 274 are positioned wholly within the inner periphery 276 of the bearing 258 and because the lower end 278 of the oil channel is spaced from the lower end 280 of the bearing oil is inhibited to some degree from escaping out the lower end 280 of the bearing. The looper bearing 258 thus encourages the oil that enters the channel 274 to remain therein and to not pass readily through the bearing into the feed dog chamber 260 positioned therebelow.

Figure 14:
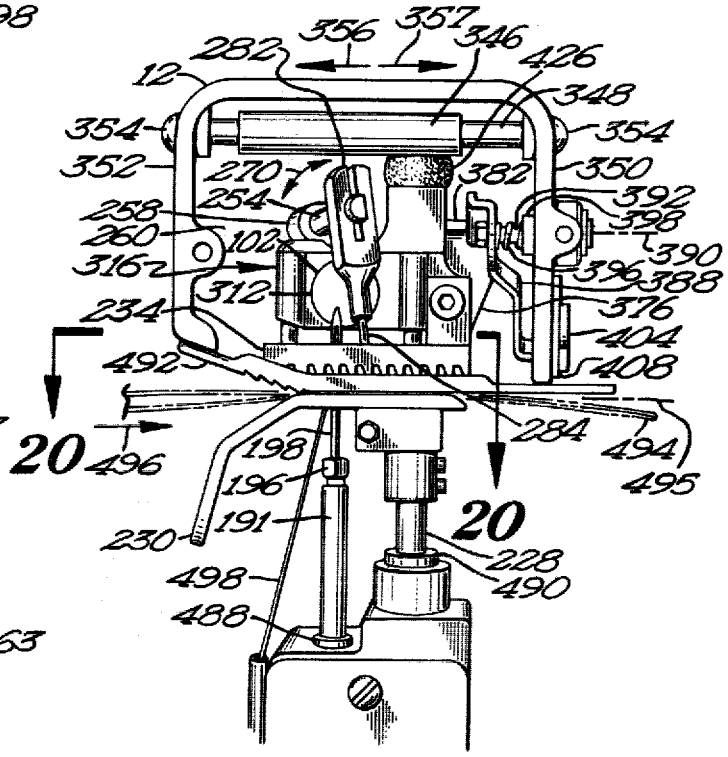
FIG. 14 is a bottom view of the feed dog chamber showing the interaction between feed dog, looper, needle driving and thread chain cutting assemblies.

Referring next to FIGS. 14 and 19, the looper shaft 254 extends downwardly from bearing 258 into the feed dog chamber 260 and at the lower end of the shaft has a looper holder 282 rigidly clamped to the shaft and carrying the looper 284 with its hooked end 286 which swings through arc 270 during operation. Since there is no movement between the looper holder 282 and the looper shaft 254, it is not essential that oil be directed to the looper holder. Some oil does drain out of bearing 258 and is useful to lubricate the interface between lower end 280 of the bearing and the split collar (not shown) which is fixed to the shaft 258 above the looper holder. Some oil does drain out of bearing 258 and is useful to lubricate the interface between lower end 280 of the bearing and the split collar (not shown) which is fixed to the shaft 258 above the looper holder.

Looper cam 176, cam follower 246, arm 252, rotatably mounted looper shaft 254, looper holder 282 and looper 284 collectively comprise the looper assembly whose operation will be further described hereafter.

A plurality of weep holes 287 and 288 (FIGS. 1 and 7) are provided in the floor 290 of the drive train chamber 14 so that any excess oil accumulating at the bottom of the chamber may be released downwardly through the holes 287 and 288 into the feed dog chamber 260 to be distributed and used in the lower chamber 260, as will be described further hereafter. A cover plate 292 covers the front opening to drive train chamber 14 and is rigidly secured to the housing 12 by means of bolts 296 passed through the plate and into bores 294 as best shown in FIGS. 1 and 9. This cover plate, when bolted in position against the housing 12, forms a part of the housing and cooperates with the already described interior walls of chamber 14 to define the drive train chamber 14.

Figure 15:
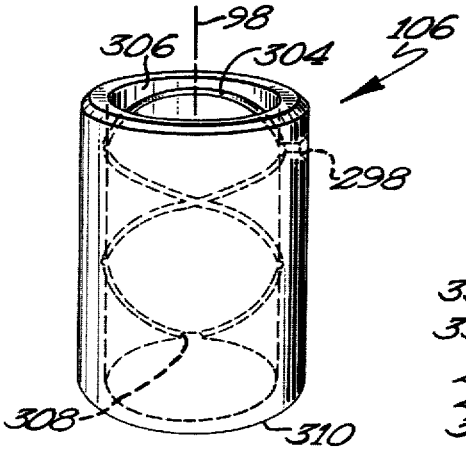
FIG. 15 is a perspective view of the lower main drive shaft bearing showing the interior oil channel in phantom.

The main drive shaft 102 extends downwardly from the drive train chamber 14 along connecting aperture 299 and into feed dog chamber 260, being journaled in lower main drive shaft bearing 106 as it passes between the chambers. The bearing 106, as shown in FIGS. 12 and 15, has an oil inlet port 298 which directly confronts and communicates with drive shaft oil accumulation trough 300 which is cut into the surface 302 of the drive train chamber. Accordingly, oil accumulating on the surface 302 flows into the trough 300 from which it is directed into the oil inlet port 298 which extends from the outer periphery 307 to the inner periphery 306 of bearing 106 to confront the drive shaft 102.

The lower main drive shaft bearing 106 has upper and lower ends 309 and 310, respectively, and is provided with an oil channel means 304 cut into the inner periphery 306 of the bearing 106 and communicating with oil port 298. The oil channel has a figure-eight configuration of a type already known to the bearing art, and the lower-most portion of the oil channel 304 joins an exit 308 which extends downward to the lower end 310 of the bearing. The shown oil channel 304 receives oil from the oil port 298 and distributes the oil within the inner periphery 306 of the bearing, providing lubrication between the inner periphery and the shaft 102. Oil channel 304 discharges excess oil entering the bearing into exit 308, the oil discharge being directed into the feed dog chamber 260.

Figure 16:
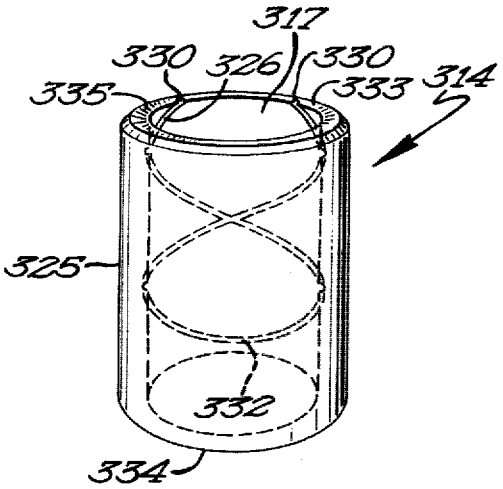
FIG. 16 is a perspective view of the feed dog bearing wherein the interior oil channel is shown in phantom.
Figure 17:
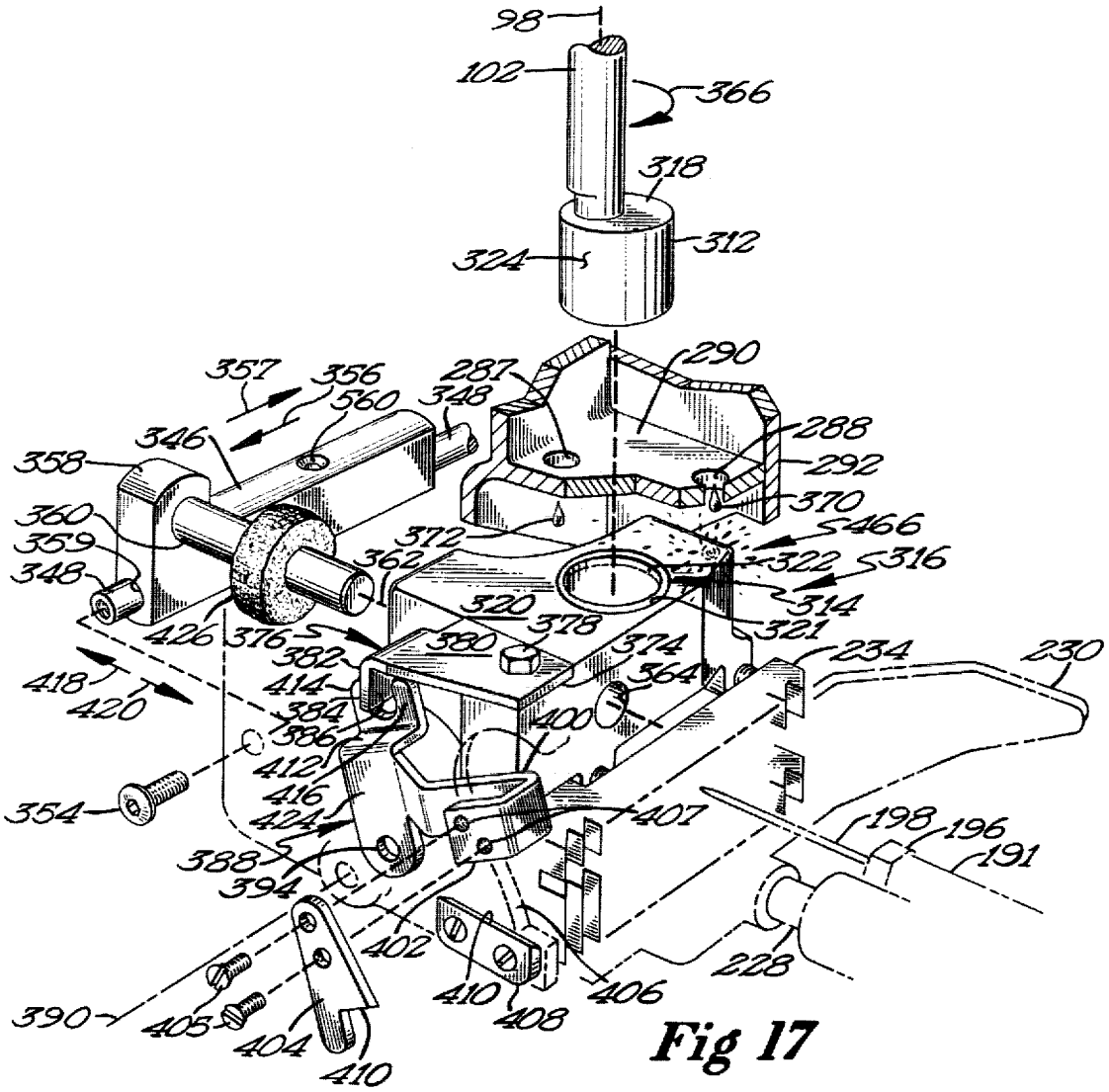
FIG. 17 is an exploded rear perspective view of the feed dog assembly and the thread chain cutting assembly with the machine housing being partially cut away or shown in phantom.

Referring now to FIGS. 7 and 17, drive shaft 102 has an offset eccentric 312 at the lower end thereof which is rotatably journaled in feed dog bearing 314 which is retained in drive shaft aperture 321 of the feed dog block 316. The upper surface 318 of the eccentric 312 is positioned slightly beneath the upper surface 320 of the feed dog block so that a feed dog block oil collection trough 322 is provided in the feed dog block and closely surrounding the main drive shaft. This feed dog block oil accumulation trough may also be provided by a chamber 333 on the upper end 335 of feed dog bearing 314, the chamber 333 being inclined downwardly from the outer periphery 325 to the inner periphery 317 as shown in FIG. 16.

Oil accumulating in the trough 322 works its way downwardly between the inner periphery 317 of the bearing 314 and the outer periphery 324 of eccentric 312 to provide needed lubrication between the eccentric and the bearing 314. This downward movement of oil is enhanced by providing the feed dog block bearing 314 with an interior truncated figure-eight type oil channel 326 which is cut into the inner periphery 317 of the bearing 314, as best shown in FIG. 16. The channel means 326 has twin entries 330 which begin at the upper end 335 of the bearing, communicate with the trough 322 and accept oil for downward movement along the channel 326. It should be noted that the lower extremity 332 of the channel 326 is spaced from the lower end 334 of the bearing in order to encourage the bearing to retain oil therein and to inhibit downward flow of oil out of the lower end 334 of bearing 314. Because the feed dog block 316 is the lowest moving part requiring oiling, there is no need for oil flow below the feed dog block.

Referring now to FIGS. 1 and 17, the housing 12 includes the feed dog chamber 260 and perforated floor plate 338 at the lower end of the housing 12 which covers the open bottom 336 of chamber 260 during normal operation, the plate 338 being secured by screw 340. The housing also includes throat plate 342 which is secured to the side of the feed dog chamber by screws passed into bores 344, the plates 342 and 338 cooperating with the housing 12 to collectively define the feed dog chamber 260.

Referring now to FIGS. 1, 14 and 17, a slide 346 is mounted for sliding reciprocating movement in directions 356 and 357 along elongated rod 348 which passes through aperture 359 of the slide and is rigidly fixed to the side walls 350 and 352 of feed dog chamber 260 by screws 354 threaded into the terminal ends of the rod 348.

Extending laterally, transversely from an upwardly extending ear 358 of the slide is a cantilevered, circular cross-section fixed rod 360 having a central longitudinal axis 362.

A transverse bearing aperture 364 receives rod 360 therein for sliding axial movement of the block 316 along the rod 360. Accordingly, the slide 346, when mounted on rod 348 with cantilever rod 360 passing through the aperture 364 of the feed dog block, supports and guides the feed dog block 316 as the block moves in response to rotation of eccentric 312 of drive shaft 102. When drive shaft 102 rotates in direction 366, the feed dog block 316 describes an elliptical, and more specifically, a circular path as it slides axially along rod 360 and as slide 346 moves with feed dog block along rod 348. The path of the feed dog block will be discussed further hereafter in conjunction with a description of the operation of the looper assembly.

Rigidly fixed to the feed dog block 316 for movement with the block is a toothed feed dog 234 which confronts and intermittently bears against presser foot 230 during operation. Because the feed dog block moves in response to rotation of the drive shaft 102, the block will be moving in its generally circular path at a speed typically ranging between 1,000 and 1,500 revolutions per minute. As oil droplets 370 (FIG. 17) fall downwardly from weep hole 288 into the path of moving block 316 the rapidly moving feed dog block collides with the falling droplets 370 and scatters the fragmented remnants 466 of the droplets in all directions, creating a mist of oil within the feed dog chamber. Oil droplets 372 falling downwardly from weep hole 287 strike rod 348 and if the feed dog block 316 and slide 346 are in motion, the moving slide 346 will shatter the oil droplets 372 to further add to the oil mist.

A porous washer or gasket 426 formed of compressible, oil-absorbing material, such as felt, leather or the like, is positioned on the rod 360 between ear 358 and feed dog block 316 so that excess oil reaching the rod 360 is absorbed and stored by the washer 426 for subsequent release. The washer 426 is constructed such that it receives slight compression each time the feed dog block moves toward the ear 358 so that some quantity of oil is released onto the shaft 360 each time the washer 426 is compressed.

Slide 346, rods 348 and 360, feed dog block 316 with feed dog 234 collectively comprise a feed dog assembly usable with the portable bag closing machine 10.

Figure 18:
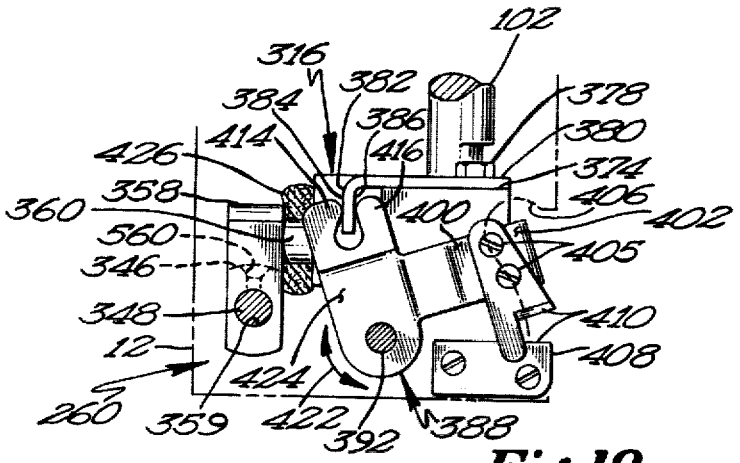
FIG. 18 is a rear view of the thread chain cutting and feed dog assemblies of FIG. 17.

Feed dog block 316 has a recessed ledge 374 in its top 320 as best shown in FIGS. 17 and 18, and a combined oil and motion transmitting member 376 is rigidly fixed to the ledge 374 by bolt 378.

The member 376 has a mounting segment 380 which fits tightly against the ledge 374 and is further provided with an angled segment 382 which extends downwardly from the mounting segment 380 at a right angle thereto and is positioned laterally of the feed dog block. The angled segment 382 is provided with front and rear surfaces 384 and 386, respectively, and these surfaces, as will be described further hereafter, serve both a motion-transmitting and an oil-transmitting function.

A knife bracket 388 is positioned primarily within the feed dog chamber 260 and is swingably mounted about axis 390 by pivot means such as cylindrical bearing assembly 392 (FIG. 18) which passes through aperture 394 in the knife bracket and extends inwardly from housing 12. A coil spring 396 (FIG. 14) is interposed between the bracket 388 and a raised boss 398 of the housing in order to bias the knife 404 against anvil 408.

Referring again to FIG. 17, the knife bracket 388 is movably mounted by the pivot means for swinging movement about the axis 390 and the bracket 388 includes an outwardly extending arm 400 which has a turned end portion 402 which carries knife 404. The end portion 402 passes through a cutaway section 406 of the housing to swing in its operating arc about axis 390. The moving knife 404 is fixed to the bracket by screws 405 which threadably engage bores 407. A stationary anvil 408 is fixed to the housing and cooperates with the knife 404 during swinging movement of the knife bracket. Preferably both knife 404 and anvil 408 are provided with sharpened cutting edges 410.

Coil spring 396 urges the knife bracket 388 away from boss 398 and causes the cutting edge 410 of moving knife 404 to closely contact the anvil 408 during cutting.

The knife bracket 388 has an L-shaped extension 412 positioned above the aperture 394 about which the bracket pivots. The extension 412 has a bifurcated arm with first and second bifurcations 414 and 416, respectively. The first bifurcation 414 closely confronts the front surface 384 and the second bifurcation closely confronts the rear surface 386 so that any components of movement of the feed dog block in directions 418 or 420 result in the angled segment 382 contacting either bifurcation 414 or 416 and causing the knife bracket to swing about pivot 392 in an arc 422, resulting in the moving knife 404 swinging toward anvil 408 and cutting the thread chain therebetween. It should be understood that the feed dog block does not move in purely straight-line fashion in directions 418 and 420 and in fact moves in a circular path. However, it should be understood that, while moving in the circular path defined by the eccentric 312, the feed dog block's movement does have some components which will be in directions 418 and 420. These motion components in directions 418 and 420 are used to move knife bracket 388 through arc 422.

It being understood that the feed dog block moves in a circular path in response to rotation of drive shaft 102 and its integral eccentric 312, it will be appreciated that some components of the circular movement will be directed along axis 390 in directions 356 or 357. Any movement of the block 316 in directions 356 or 357 causes the angled segment 382 to move relative to the bifurcations 416 and 418 alternately causing one or the other of the bifurcations to scrape against the front or rear surfaces 384 or 386, respectively. This scraping movement of the bifurcations against the front and rear surfaces of the angled segment 382 causes oil on the front and rear surfaces to accumulate on the bifurcations. The oil on the angled segment 382 originates from oil entering the feed dog chamber by weep hole 288 or seeping downwardly along the main drive shaft 102 or the looper shaft 254, much of such oil eventually reaching the upper surface 320 of the feed dog block. Rapid rotation of the drive shaft 102 and the consequent movement of the feed dog block tends to urge much of this oil radially outwardly along the top of the block due to centrifugal force, and some of this outwardly moved oil reaches the member 376 and flows down the angled segment 382. Naturally, some accumulation of oil on the angled segment also results from the presence of the oil mist in the feed dog chamber.

Accordingly, components of movement of the feed dog block in directions parallel to axis 390 impart no movement to knife bracket 388 but do cause oil to be accumulated on the bifurcations 414 or 416. Such accumulating oil flows downwardly along extension 412 until it reaches the segment 424 of the bracket, thereafter continuing its flow until it reaches the pivot screw 392 to provide needed lubrication to the assembly 392. Accordingly, the scraping action of the bifurcations 414 and 416 capture sufficient oil from angled segment 382 to produce a flow downwardly to the pivot screw so as to provide the necessary lubrication between screw 392 and the knife bracket 388.

The member 376, knife bracket 388, bearing assembly 392, knife 404 and anvil 408 collectively comprise a thread chain cutting device used with the machine 10 to sever the threads remaining after a bag-stitching job is completed.

In operation, the self-oiling portable sewing machine 10 is firmly grasped by the operator's hand encircling the handle 16 and generally held in the shown operating position of FIG. 1 in which the handle 16 is at the top of the machine and the needle 198 at the bottom. The operator visually inspects the oil reservoir 40 to confirm that the oil level therein is at an adequate level and adds oil to the reservoir 40 through filling aperture 50 if needed. The inspection is greatly simplified by the generally translucent walls 46 of the reservoir 40 permitting an operator to readily determine the internal oil level by casual visual inspection.

As the motor 30 begins its rotation in response to the operator depressing push button switch 26, the vibration of the motor intermittently unseats valve ball 78 from its closed position 82 to an open position permitting oil flow from within the reservoir 40 downwardly in direction 430 through the valve 68 in direction 428 into tubing 88. As oil flows slowly out of the reservoir 40, ambient air enters the reservoir through vent aperture 58, passing through filters 60 to vent the reservoir and assure continued downward flow from the reservoir whenever the valve 68 opens. The presence of the filter elements 60 assures that no dirt, dust or other foreign elements enter the oil reservoir to produce clogging or abrasion in the machine.

While vibration of the machine 10 produced by motor operation is one way in which the valve 68 may be intermittently opened, it has been found that physical movement of the machine, as when an operator picks up the machine, uses it for stitching a bag, or swings it to actuate the thread chain cutting device, as will be described further hereafter, is adequate to unseat the ball 78 from the valve seat 76 and occasion oil flow 430 from the oil reservoir 40.

Figure 22:
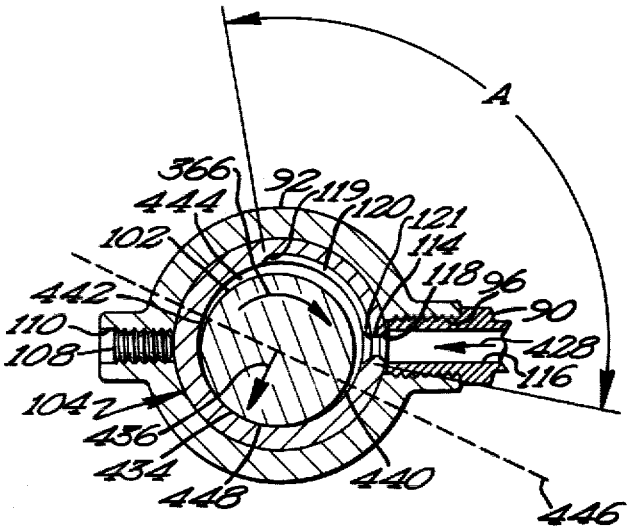
FIG. 22 is a cross-sectional view of a part of the housing and of the upper main drive shaft bearing taken in the direction of cutting plane 22—22 of FIG. 5 and in which the drive shaft diameter has been exaggeratedly decreased for purposes of illustration in order to describe oil flow in the bearing during operation.

Referring now to FIGS. 1, 5 and 22, oil flow moves along the hose 88 in direction 428 and enters the channel 116 of nipple 90. The oil then flows into countersink 118 of oil port 114 of the upper main drive shaft bearing 104. If the drive shaft 102 is stationary, the oil flows from oil port 114 and primarily downwardly along the generally upright channel 122, as best shown in FIGS. 5 and 6, the oil leaving the bearing 104 at exit 125 and dripping downwardly as shown by oil drops 432. The drops 432 normally flow downwardly along eccentric collar 138 when the shaft 102 is stationary. Some slight amounts of oil will also flow from the oil port 114 laterally along the horizontal channel 120 even when the drive shaft 102 is stationary, but while the drive shaft is unmoving, most oil flow will be down the generally vertical channel 122 and thence into the drive train chamber 14.

When the drive shaft 102 is rotating at normal speeds between 1,000 to 1,500 revolutions per minute, it cooperates with the upper main drive shaft bearing 104 to perform a pumping action by which the bearing 104 is lubricated and oil is moved more readily through the bearing and into the drive train chamber 14, and this pumping action of the bearing 104 and shaft 102 will now be described in conjunction with FIG. 22.

Referring now to FIG. 22, the cross-sectional view of shaft and bearing has been drawn with the diameter of the drive shaft 102 being shown as substantially smaller than the internal diameter of bearing 104 for purposes of illustration only. Actually the diameter of the drive shaft 102 will be much more nearly equal to the internal diameter of the bearing 104 aside from the necessary allowance for free rotation therebetween.

Oil flows into the nipple 90 as indicated by flow arrow 428 and passes through the oil port 114 to enter the interior of bearing 104. The rapidly rotating shaft 102 will be closely contacting and more heavily urged against the region 434 of the bearing to apply a force 436 thereagainst because of the timing belt 130 (FIG. 1) pulling the shaft 102 in the general direction of the motor pulley 132. As a result of the force 436, the shaft 102 will be most tightly urged against the region 434 of the bearing.

Oil entering the interior of the bearing 104 will come into contact with the rotating shaft 102 and will adhere to it by normal adhesion and will be carried along with the shaft 102 in its rotational direction 366. Oil adhering to the shaft 102 will thus be carried from port 114 in the direction 366 and an increasing quantity of oil will be accumulating in the region 440, and accordingly this is a region of high oil pressure and there is no difficulty in providing adequate oiling to the region 440; the region 434 will have comparable or even higher pressure. Because, however, it is desirable to lubricate all sides of the bearing's inner periphery, it is important to deliver oil to the region 442; however, in the absence of the present invention oil does not flow readily in a clockwise direction 366 from the region 440 or 434 to the region 442. In the region 442, a suction condition is generated as a natural result of the high pressure of regions 434 and 440. The horizontal channel 120 extends from the oil port 114 toward the suction region 442 and the suction pulls oil from port 114 and along channel 120 to the region 442 for lubrication of that region of the bearing. Due to the above described behavior of the bearing 104, it has been found necessary that oil port 114 not be placed in the region 434 or else the high pressure generated by the rotating shaft 102 tends to force oil out of the bearing and back into nipple 90, preventing the needed flow of incoming oil. Accordingly, it has been found desirable that the oil port 114 be placed in the unloaded half of the bearing 104, the unloaded half being indicated as the half 444 lying on the indicated side of line 446 which is perpendicular to force vector 436. The oil port 114 should preferably not be positioned in the loaded half of the bearing indicated as 441 if best results are desired.

It has also been found desirable that the arc A subtended by the oil port 114 and horizontal channel 120 be on the order of 90° to 150° although best results have been attained with angles ranging between 95° and 130°.

Oil drops 432 working their way out of the lower end 124 of the bearing 104 flow onto the raised projection 148 (FIGS. 7 and 8) of the eccentric collar 138 and, particularly when the motor 30 is off, oil works its way downwardly onto the surface 141 of the eccentric and into oil accumulation groove 139 for downward seepage between the surfaces 143 and 441 to provide lubrication and encourage free rotational movement of the eccentric relative to surface 441. Some oil on the surface 141 drains downwardly through oil bores 137 such as drop 454 to fall onto the looper cam 176 as will be described further hereafter.

Oil droplets such as 454 leaving the oil bore 137 of the eccentric fall on the upward projection 240 of the looper cam and flow downwardly to the surface 250, some of the oil dropping down through oil flow hole 247 into cam follower slot 244 to be picked up by the cam follower 246 to provide lubrication, it being understood that the oil droplets 455 are also spread about and distributed along the slot 244 by the moving cam follower 246 to assure adequate lubrication between the cam follower and its slot.

When the operator depresses switch 26, the electric motor 30 is energized and begins rotating. Rotation of pulley 132 by the motor shaft turns belt 130, causing pulley wheel 126 to rotate and to move main drive shaft 102 in direction 366 at a speed of approximately 1,000 to 1,500 revolutions per minute depending on the loading of the machine and on its general age and condition.

When drive shaft 102 is rotating, the centrifugal force generated by the rotating eccentric collar 138 and looper cam 176, as well as inertial forces associated with moving connecting rod 146, tends to fling much of the oil on these structures radially outwardly from the axis 98 of shaft 102 and toward the interior walls of the drive train chamber 12. As the speed of the eccentric and the looper cam increases and decreases in response to start-up and stoppage, the centrifugal force applied to such oil droplets varies and accordingly the outward path of the hurled oil droplets will sometimes be almost horizontal as with droplets 458 (FIG. 9) and at other times they will drop more rapidly in a hyperbolic arc as shown by the droplets 458 in FIG. 7, thus resulting in a well-distributed spray of oil. The outwardly flung oil 458 from collar 138 and cam 176, if not intercepted by the machine's internal components, strikes the inner walls of the drive train chamber 14 and is fragmented into a multiplicity of fine oil droplets to create a mist of oil throughout the drive train chamber, such mist working its way into virtually all moving parts and covering all surfaces which are exposed to it.

As a fine layer of oil accumulates on the various moving parts and bearings, such oil tends to work its way into the bearings and internal chambers, passages and channels by capillary action as well as by gravity flow. The interaction of the various oiling methods described herein such as gravity flow, spraying of oil, the creating of an oil mist, wicking, and capillary action collectively assure a more effective composite oiling system than any yet used with a portable bag-closing sewing machine.

In addition to establishing the described mist, oil droplets thrown outwardly against the walls of the drive train chamber 14 also tend to accumulate to a degree on the walls of the chamber 14 and eventually coalesce to form larger droplets 460 which drain downwardly toward shelf 262 and the surface 302 as best shown in FIG. 12.

Oil droplets 460 accumulate on shelf 262 and work their way into looper shaft oil accumulation trough 264 which is inclined downwardly toward the oil inlet port 268 to encourage flow toward the port 268. As oil enters port 268 it moves through the wall of the looper shaft bearing 258 and enters channel means 274 within the bearing, as best shown in FIG. 13. The oil works its way along channels 274 by gravity flow to provide comprehensive lubrication to the inner periphery 276 of the bearing and assure smooth rotation between looper shaft 254 and looper bearing 258. Because the lowermost extremity 278 of the channel means 274 does not communicate with the lower end 280 of the bearing, oil leaves the bearing 258 relatively slowly and only by slight and gradual seepage.

Referring again to FIG. 12, oil drops 461 accumulating near the bottom 302 of the drive train chamber 14 flow into trough 300 which leads to oil inlet port 298 in lower main drive shaft bearing 106 and moves through the port to the oil channel 304 (FIG. 15) situated on the inner periphery 306 of that bearing. The oil moves along channel 304 providing lubrication to main drive shaft 102 for easy rotation within the bearing, the oil then draining out exit 308 and flowing downwardly along main drive shaft 102 as best shown by oil droplet 462 in FIG. 7. Droplets 462 on the outer periphery of the drive shaft 102 will flow downwardly to feed dog block 316 if the drive shaft is stationary, but if the motor 30 is operating, the rapid rotation of drive shaft 102 is likely to hurl the droplets 462 outwardly, as shown by droplets 464, and against the walls of the feed dog chamber 260 to shatter the drops against the chamber, forming a mist of oil within chamber 260. This oil mist tends to work its way into virtually all of the moving parts within chamber 260.

Oil droplets from exit 308 of lower bearing 106, or from downward flow from weep hole 288, or those which settle out of the described oil mist, eventually accumulate on the upper surface 320 of feed dog block 316 (FIG. 17) and these droplets accumulate in trough 322 when the motor 30 is off and the block 316 is stationary. Oil within trough 322 works its way through entries 330 in the upper end 335 of feed dog bearing 314 (FIG. 16) and thence moves along oil channel 326 within the bearing to provide needed lubrication for the eccentric 312 to rotate freely within bearing 314. Channel means 326 of bearing 314 terminates short of the lower end 334 of the bearing so that oil within channel 326 is retained within the bearing for a longer interval and only escapes slowly by seepage. There is no compelling reason for encouraging downward seepage of the oil out of the lower end of bearing 314 because there are no moving parts beneath the bearing which require lubrication.

When the motor 30 is actuated while a quantity of oil is retained in oil collection trough 322, such oil 464 (FIG. 7) is hurled outwardly by centrifugal force applied to the moving block 316 and flows radially outwardly from shaft 102 to the outer edges of the feed dog block 316 and much of such oil is hurled against the walls of feed dog chamber 260 to add to the intensity of the oil mist within the chamber.

Referring now to FIGS. 7 and 17, oil accumulating near the bottom of the drive train chamber 14 is discharged from chamber 14 through weep holes 287 and 288. Oil 370 passing downwardly through weep hole 288 is likely to be intercepted by feed dog block 316 during its normal movement in response to rotating eccentric 312. When droplets 370 are intercepted by the rapidly moving feed dog block 316 the droplet is shattered, as best shown at 466, to further add to the oil mist within feed dog chamber 260. In the event the feed dog block is stationary when the oil 370 falls, it is more likely to accumulate on surface 320 of the feed dog block and subsequently reach the trough 322 or be hurled outwardly when the machine is next actuated.

Similarly, oil droplets 372 discharged from weep hole 287 are likely to land on rod 348 or be intercepted by moving slide 346. If intercepted by the slide, the droplet 372 is likely to be shattered and further contributes to the intensity of the oil mist within the chamber. Should the machine be inactive, the droplet 372 will be received on rod 348 and be used for lubrication of the rod for improved sliding movement of slide 346. Naturally, the weep holes 287 and 288 also serve a useful function in preventing any unneeded over accumulation of oil on the bottom of the drive train chamber.

Oiling port 560 in the upper surface of slide 346 extends down to and communicates with slide aperture 359 to introduce oil to the interface between aperture 359 and rod 348. Oil reaches port 560 from oil drops sprayed outwardly by moving feed dog block 316 or from the oil mist within the chamber 260 and flows downwardly therein.

When motor 30 is actuated and caused the rotation of main drive shaft 102 in direction 366, as shown in FIG. 17, the movement of eccentric 312 results in the feed dog block 316 moving in a generally circular path centered on the axis 98 of the shaft. As the feed dog block follows the circular path prescribed by the eccentric 312, it carries along with it the slide 346 which has its rod 360 slidably received within bearing aperture 364. As the feed dog block 316 slides alternately in directions 418 and 420 along the rod 360, the slide 346 also moves in directions 356 and 357 to follow the movement of the feed dog block. Accordingly, the slide 346 which is slidably mounted on rod 348 provides support for the feed dog block 316, and various operating positions of the feed dog block and of slide 346 are illustrated in FIGS. 14, 19 and 21. In FIG. 19, the slide 346 is near its left-most extremity of rod 348 and closely adjacent wall 352. As the eccentric 312 turns in response to rotation of shaft 102, the feed dog block moves to the right, as viewed in FIGS. 14, 19 and 21, causing the slide 346 to move in direction 357. Since the feed dog block is moving in a circular path whose plane is perpendicular to the axis 98 of the drive shaft 102, the feed dog 234 also follows a circular path and alternately moves in direction 420 to bear against presser foot 230 and in direction 418 to recede from the presser foot as a bag 494 moves along its path 495 through the machine 10. This type of circular or elliptical movement of the feed dog block is found in most sewing machines and is used to advance the bag or fabric which is being sewed. Since such basic movement of a feed dog block to cause forward movement of a bag or fabric through the machine is well known to the art, it will not be described further here.

During the movement of feed dog block 316 along its circular path, the block slides along rod 360 toward and away from the ear 358. During such movement the block moves against oil-retaining annular gasket 426 causing oil stored in the porous gasket to be released onto the rod 360 to provide needed lubrication. Similarly, as the pressure of compression is removed from gasket 426, it soaks up any excess oil on rod 360 and stores it for future use.

It should be understood that the circular path followed by feed dog block 316 in response to rotation of eccentric 312 is centered on axis 98 and produces a total side-to-side displacement on the order of one-fourth to one-half inch. Accordingly, the movement of the angled segment 382 in direction 356 or 357 is such that one of the bifurcations 414 or 416 substantially always engages the angled segment 382. During the circular movement of block 316 it has components of movement in the directions 418 and 420, either of which results in the angled segment 382 swinging the knife bracket 388. Accordingly, when the feed dog block (FIG. 17) is moving in direction 420, the surface 386 of the angle clip contacts bifurcation 416, swinging knife bracket 388 about assembly 392 and bringing the L-shaped extension 402 of arm 400 downwardly toward the stationary anvil 408. Such movement results in the knife 404 moving downwardly with its cutting edge 410 closing on the cutting edge of the stationary anvil 408 to cut the thread chain therebetween.

As the feed dog block 316 moves in direction 418 in the course of its movement along the circular path, the surface 382 bears against bifurcation 414, swinging the knife bracket 388 about axis 390 and swinging the L-shaped portion 402 away from the stationary anvil 408, causing the moving knife 404 to rise to a cocked position in preparation for the next downward cut.

When the feed dog block in response to its movement along the circular path moves in direction 356 or 357, the angled segment 382 tends to have either its surface 384 or 386 scrape against bifurcation 414 or 416, respectively, resulting in the rubbing off of any excess oil on the surface 384 or 386 onto the bifurcation 414 or 416, respectively. The oil picked up by the wiping or scraping action of the angled segment 382 against the bifurcations accumulates and moves downwardly onto the surface 424 and works its way into the assembly 392 so as to provide adequate lubrication between the knife bracket 388 and the assembly 392.

The bottom of the feed dog chamber 260 is closed by a removable perforated plate 338 (FIG. 1), the perforations of the plate permitting the escape of any excess oil that might build up within the feed dog chamber, it being understood that oil coming to rest on plate 338 is of little use for lubricating the various components positioned above the plate and, accordingly, can be permitted to drain out or to evaporate into the atmosphere.

Referring again to FIGS. 1, 7 and 11, the rotation of looper cam 176 moves cam follower 246 continuously along the track 244 on the underside of cam 176. Accordingly, rotation of looper cam 176 causes the arm 252 to swing reciprocally through an arc 270 (FIGS. 14, 19 and 20), resulting in the looper shaft 254 and the looper 284 swinging through the arc 270 in which looper hook 286 follows a path 468, closely bypassing the needle 198. The operation of the looper in conjunction with the needle and the feed dog will be described further hereafter.

Referring now to FIGS. 1 and 8, as the drive shaft 102 turns about its longitudinal axis, eccentric collar 138 rotates therewith and causes the connecting rod 146 to move reciprocally in directions 162. While there is some movement of the end 474 in directions 476, such movement is incidental and only the movement 162 plays a direct role in operating needle drive lever 156; such movement 476 of rod end 474 does, however, aid in flinging oil outwardly at the walls of chamber 14. Accordingly, longitudinal movement 162 is transmitted through universal joint 152 to needle drive lever 156 which swings through a small arc 478 about post 158.

Referring next to FIG. 9, oil droplets 458 hurled outwardly from the rotating shaft 102, eccentric 138 and looper cam 176 in direction 470 directly or indirectly lubricate the moving parts comprising the needle driving assembly and presser foot unit. Droplets 458 striking the area of the universal joint 152 provide direct lubrication to it while droplets 458 which are fragmented against the inner wall of chamber 14 are broken up into tiny mist-like droplets which indirectly settle upon all parts in the chamber 14.

Wicking 180 which extends closely about joint 202 (FIG. 1) between housing 12 and needle drive lever 156 absorbs oil from chamber 14 and releases oil into joint 202 to provide oil to the joint 202 which works itself into the joint by a combination of capillary action and gravity flow. The rocking movement of lever 156 through arc 478 also assists in distributing oil more evenly in joint or interface 202.

Referring now to FIG. 9, some of the droplets 458 directly hit the countersink 170 and enter oil port 168 to work their way into the annular oil slot 172 so as to provide lubrication between shaft 158 and needle drive lever 156. Accumulating sprayed droplets 472 on the lever 156 work their way downwardly and flow naturally into the countersink 170 to further add to the lubrication of the shaft 158.

As needle lever 156 rocks about post 158, the longitudinal shaft 164 moves longitudinally in directions 480 while pivoting about axis 482 and causes the needle drive shaft 191 to move in directions 192 and 484 to move the needle 198.

Referring now to FIG. 9, oil is introduced within the hollow interior 178 of longitudinal shaft 164 by oil-impregnated wicking 180. Oil released from the wicking passes outwardly through radial oil port 182 to lubricate the interface between shaft 164 and bearing surface 184. Naturally, oil is also deposited on the exterior surface of shaft 164, which extends outside sleeve 163, as a consequence of the oil mist within the chamber. Such oil is also used in the lubricating of the interface. The pivotal mounting between shaft 164 and clamp 188 is lubricated by oil deposited from the oil mist and additionally by oil released from the wicking 180 which passes in close contact with the pivot.

Needle drive shaft 191 slides in its bearings 488 and requires lubrication for the bearings which is supplied by the oil mist and the downward falling droplets 458 which fall on shaft 191 and work their way into the bearings.

Referring now to FIGS. 9 and 10, upper end 206 of the presser foot unit is lubricated by means of oil transferred to felt washer 216 by direct flow from the walls of the chamber 14 or by transfer from oil-impregnated wicking 180. Such oil enters the interface between bearing 212 and self-aligning insert 213, which is retained on post 208, to provide lubrication and permit free swinging of the lifter lever 204 about the post 208. Rod 222 telescopes into and out of hollow shaft 218 and the interface between shaft 218 and rod 222 is lubricated by oil entering the twin apertures 220, such oil being supplied by droplets 486 running down the exterior of lifter lever 204 and entering the holes 220. The lower end 224 (FIG. 1) of rod 222 is pivotally mounted to bifurcated clamp 226 and the pivotal mounting receives adequate lubrication from the oil mist established in the chamber and deposited on the mounting.

The presser foot shaft 228 is lubricated by deposition of oil thereon from mist and spray within the chamber 14 and such deposited oil works its way into the bearings 490 which slidably receive the presser foot shaft.

Referring now to FIGS. 14 and 21, the presser foot 230 exerts a positive force in the direction of throat plate 492 so as to urge the bag 494 into firm contact with the feed dog 234 and the presser foot 230 cooperates with the feed dog to permit moving of the bag in direction 496 during operation. As will be appreciated by those skilled in the art, the position of the needle shaft 191, the looper shaft 254 and the angular orientation of the eccentric of drive shaft 102 must be closely coordinated for the sewing machine components to function properly. The proper timing and interaction of the needle shaft, looper shaft, and feed dog is readily accomplished by properly positioning eccentric collar 138 and looper cam 176 on drive shaft 102. Since such positioning is well known and understood by those skilled in the art, no detailed description of the angular relationships will be described herein.

In stitching a bag 494 closed with thread 498 from spool 503, the bag moves in direction 496 between the presser foot 230 and the feed dog 234, as best shown in FIGS. 14 and 21. Needle shaft 191 moves through an aperture in the presser foot, drives the needle 198 through the bag and through aligned apertures in the throat plate 492 and feed dog 234, carrying the thread 498 well within the feed dog chamber, as best shon in FIGS. 14 and 20. As the needle 198 is well within the feed dog chamber, the looper shaft 254 and looper 284 are swinging toward the needle in direction 501 along path 468 that will cause looper hook 286 to move almost tangent to the circular periphery of the needle.

Referring now to FIGS. 21 and 23, as needle 198 withdraws from the feed dog chamber the thread 498 already carried within the chamber leaves a loop 500 which is immediately captured by hook 286 of the swinging looper 284 as it moves toward wall 352. As needle 198 is fully withdrawn (FIG. 19) the looper hook 286 completes its forward movement in direction 356 and, as it retains the loop 500, spreads it over opposed sides 502 and 504 of ramp 506 which is carried by the throat plate 492 (FIGS. 20 and 21). While the loop 500 is spread apart by cooperation of the looper hook 286 and the ramp 506, the needle 198 again descends toward the feed dog chamber 260 and through bag 494, at the end of which descent the needle will pass through the loop 500 and the looper will swing back to its starting position clear of the needle as shown in FIG. 14. Before the needle descends to catch loop 500, feed dog 234 moves in direction 357 and advances the bag 494 a predetermined distance so that the next downward thrust of the needle will pass through the bag at a new location to define the next stitch. As the needle moves through the bag 494 and through loop 500 the looper hook 286 releases the loop and movement of the needle causes the loop 500 to be pulled tight to form the stitch.

As the needle begins its upward movement the looper shaft 254 swings again in direction 501 to engage the new loop and the looping process begins again.

As the bag 494 is stitched closed and leaves the machine, a chain stitch or thread chain is formed from the edge of the bag to the needle and must be severed to free the bag from the machine. To sever the chain, the operator swings the portable bag-closing machine such that the thread chain is urged between the anvil 408 and the moving knife 404.

Figure 24:
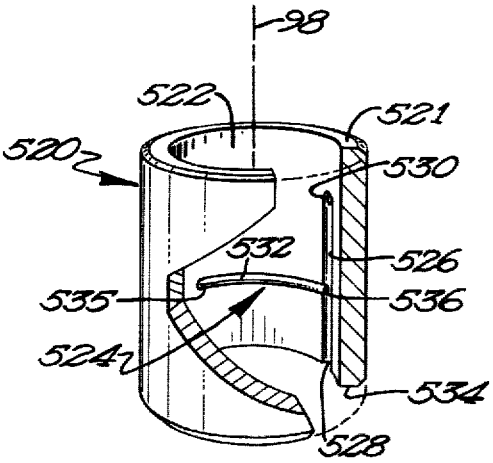
FIG. 24 is a perspective view of an alternative embodiment of an upper main drive shaft bearing with the side wall partially cut away to reveal the internal oil channel arrangement.

Referring now to FIG. 24, an alternative embodiment 520 of an upper main drive shaft bearing is shown and the bearing 520 may be substituted for the already described bearing 104 and is an acceptable alternative in place thereof. The bearing 520 has inner and outer peripheries 522 and 523, respectively, and a channel means 524 is cut into the inner periphery of the bearing so as to guide oil flow along the inner periphery of the bearing. The channel means 524 has a generally upright channel 526 which is substantially parallel to the central axis 98 of bearing 522 and has an exit 528 at the lower end 534 of the bearing to enable oil to leave the bearing and flow downwardly to eccentric 138 The uppermost end of channel 526 communicates with a generally radial oil port 530 which is spaced downwardly from upper end 521 of the bearing and which is virtually identical to the oil port 114 in bearing 104, extending between the inner and outer peripheries of the bearing. A horizontal channel 532 extends laterally from channel 526 and has first and second lateral extremities 535 and 536, respectively, the channel 532 being approximately midway between port 530 and exit 528 and lying in a plane substantially perpendicular to axis 98. It has been found that the angle subtended by the lateral extremities 535 and 536 should be within the same range described in conjunction with the angle A of bearing 104 for best operation and that orientation of the channel means 524 in the unloaded half of the bearing is preferably arranged as described for bearing 104 shown in FIG. 22. In operation, the bearing 520 functions as described in conjunction with bearing 104 except that the oil must of course flow first from the oil port 530 downwardly to the juncture of channels 532 and 526 before moving horizontally along channel 532 in response to the suction which moves oil along the channel 532, as has already been described in conjunction with horizontal channel 120 of bearing 104.

Figure 25:
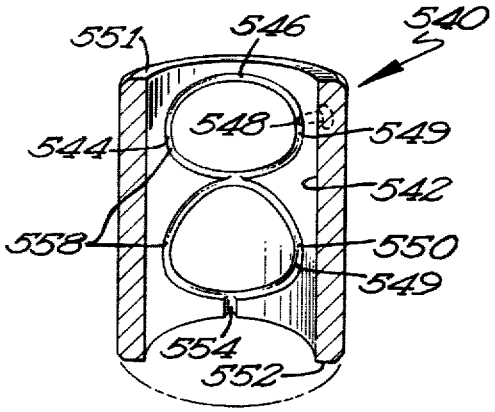
FIG. 25 is a perspective view of a second alternative embodiment of an upper main drive shaft bearing wherein a portion of the bearing wall has been cut away to show the configuration of the internal oil channel configuration.

Referring next to FIG. 25, a second alternative embodiment 540 of an upper main drive shaft bearing is shown, the bearing 540 having upper and lower ends 551 and 552, respectively, and inner and outer peripheries 542 and 543, respectively. A figure-eight shaped oil channel means 544 is cut into the inner periphery 542 and has first and second lateral extremities 558 and 549, respectively. The upper loop 546 of the channel means communicates with oil port 548 which is identical to the oil port 144 of bearing 104, and port 548 extends between inner and outer peripheries 542 and 543 and is positioned at the second lateral extremity of the channel means. The lower loop 550 communicates at its lowermost portion with an exit 554 which extends to the lower end 552 of the bearing to conduct oil from the lower loop 550 as was the case with bearing 104. The angle subtended by the lateral extremities 558 and 549 should be within the same range described in association with the angle A of bearing 104 and the orientation of the channel means 544 should preferably be in the unloaded half of the bearing as was described in conjunction with FIG. 22.

In operation the bearing 540 is mounted as described in conjunction with bearing 104, oil port 548 communicating with the nipple 90 to receive oil therefrom, and the channel means 544 being positioned in the unloaded half of the bearing.

During operation, while shaft 102 is rotating within the bearing 540, oil entering the oil port 548 works its way downardly to the junction between upper and lower loops 544 and 550 and then continues downwardly to the exit 554. The suction already described and associated with the region 442 (FIG. 22), causes oil to be drawn to the region of the first lateral extremity 558 of the bearing (FIG. 25) to assure more uniform lubrication of the bearing and of moving shaft 104. As described in conjunction with bearing 104, oil passing through bearing 540 moves downwardly out of exit 554, introducing oil into the drive train chamber and thereafter to the remaining moving parts of the machine.

While the preferred embodiments of the present invention have been described, it should be understood that various changes, adaptations and modifications may be made therein without departing from the spirit of the invention and the scope of the appended claims.

What is claimed is:

1. A self-oiling portable bag-closing sewing machine energizable from a power source, and capable of using thread to stitch a bag closed comprising:

a housing having an internal drive train chamber and said housing including a handle for carrying the machine;

first and second main drive shaft bearings, each said bearing having a central axis, each being carried by said housing, said bearings being positioned substantially coaxially, and each said bearing having an inner and an outer periphery, and an upper and a lower end;

driving means selectively connectable to the power source, carried by said housing, and including a motor and a main drive shaft rotatably mounted in said first and second main drive shaft bearings for rotation about the longitudinal axis of said main drive shaft, and said main drive shaft extending within said drive train chamber and being drivingly connected with said motor to rotate said main drive shaft when the motor is energized;

a needle driving assembly including a needle having a longitudinal axis, said needle driving assembly being operatively movingly connected with said driving means to move said needle along said longitudinal axis of said needle in reciprocating movement in response to energizing of said driving means;

a feed dog assembly carried by said housing and operatively connected to said driving means to actuate said feed dog assembly for cooperation with said needle driving assembly in response to energizing of said driving means;

a presser foot unit carried by said housing and selectively bearing against said feed dog assembly and cooperating with said feed dog assembly to urge the bag against said feed dog assembly and thereby assist in moving the bag along a path past the needle;

a looper assembly carried by said housing and operatively connected with said driving means, said looper assembly cooperating with said reciprocating needle to form a stitch with the thread so as to cause the bag to be stitched closed as the bag moves along the path;

an oil reservoir capable of storing the oil and carried by said housing; and oil delivery means connected in fluid flow relation with said oil reservoir and with said housing to direct oil to said drive train chamber and onto at least one of said assemblies for dispersion within said drive train chamber by outward flinging of such oil within said chamber by at least one of said assemblies during operation of the sewing machine.

2. The self-oiling portable bag-closing sewing machine of claim 1 wherein said oil delivery means includes an oil delivery bore through said housing and confronting said outer periphery of said first main drive shaft bearing, said delivery means further including an oil port in said first main drive shaft bearing communicating with said oil delivery bore and passing through said first main drive shaft bearing to confront said main drive shaft within said first bearing so as to deliver oil to said main drive shaft.

3. The self-oiling portable bag-closing sewing machine of claim 2 wherein said oil delivery means includes an oil metering valve connected in fluid flow relationship between said oil reservoir and said first main drive shaft bearing and being actuatable between a closed condition wherein oil flow through said valve is restricted, and an open condition wherein oil flows through said valve, said valve being oriented to remain in a closed condition when the power supply is off and said machine is in an operating position and opening in response to intermittent movement produced by vibration of said driving means and by manual movement of the machine by an operator.

4. The self-oiling portable bag-closing sewing machine of claim 2 wherein:

said first main drive shaft bearing is located adjacent the top of said main drive shaft when the machine is in operating position; and wherein said oil delivery means includes oil channel means on said inner periphery of said first main drive shaft bearing, said oil channel means communicating with said oil port and extending downwardly to said lower end of said first main drive shaft bearing to guide oil from said oil port along said inner periphery of said first main drive shaft bearing and out of said first main drive shaft bearing to permit oil to pass through said first main drive shaft bearing for dispersion within said drive train chamber.

5. The self-oiling portable bag-closing sewing machine of claim 4 wherein said oil channel means includes a channel on said inner periphery of said first main drive shaft bearing and substantially parallel to a plane perpendicular to said central axis of said first main drive shaft bearing so as to move oil laterally of said oil port and within said first bearing.

6. The self-oiling portable bag-closing sewing machine of claim 4 wherein said oil channel means includes a channel on said inner periphery of said first main drive shaft bearing and extending laterally relative to said oil port and within said first main drive shaft bearing so as to move oil laterally of said oil port.

7. The self-oiling portable bag-closing sewing machine of claim 4 wherein said first main drive shaft bearing is integral having a loaded half against which said main drive shaft bears more heavily in response to rotational energy transmitted to said main drive shaft by said motor and an unloaded half opposite said loaded half, and said oil channel means and said oil port being located in said unloaded half of said first main drive shaft bearing so that during rotation of said main drive shaft said rotating drive shaft cooperates with said oil channel means to produce a pumping action within said first main drive shaft bearing wherein oil is urged along the inner periphery of said first main drive shaft bearing and from said oil port to said lower end of said first bearing and into said drive train chamber.

8. The self-oiling portable bag-closing sewing machine of claim 4 wherein said oil channel means includes a channel formed on said inner periphery of said first main drive shaft bearing, said channel having a figure-eight configuration with upper and lower loops and with said oil port entering said figure-eight configuration in said upper loop, and said channel means further including an exit formed in said inner periphery of said first main drive shaft bearing and extending between said lower loop of said figure-eight configuration and said lower end of said first main drive shaft bearing to conduct oil out of said first main drive shaft bearing.

9. The self-oiling portable bag-closing sewing machine of claim 4 wherein said oil channel means has first and second lateral extremities when viewed from said central axis of said first main drive shaft bearing, said oil port communicates with said oil channel means at said second lateral extremity of said oil channel means with said oil channel means being positioned laterally from said oil port toward said first lateral extremity and said drive means connected to turn said main drive shaft in a direction from said first lateral extremity, across said oil channel means and toward said second lateral extremity when said driving means is energized.

10. The self-oiling portable bag-closing sewing machine of claim 1 wherein said needle driving assembly includes an eccentric collar fixed to said main drive shaft adjacent said first main drive shaft bearing for rotation with said main drive shaft and to receive oil from said oil delivery means and to fling oil outwardly within said drive train chamber to cause such oil to be showered throughout said chamber and to be substantially fragmented against said chamber walls into a multiplicity of fine droplets as a result of impact with said drive train chamber walls so as to create a mist of oil within said drive train chamber.

11. The self-oiling portable bag-closing sewing machine of claim 10 wherein:

said needle driving assembly includes a connecting rod having first and second ends, said first end of said connecting rod rotatably receiving said eccentric collar to cause said connecting rod to engage in reciprocating movement in response to rotation of said main drive shaft, and said second end of said rod having a universal joint;

said eccentric collar extending upwardly along said main drive shaft above said connecting rod; and said connecting rod extending outwardly from said main drive shaft so that oil flung outwardly by said rotating eccentric collar falls on said universal joint and assists in lubricating said universal joint.

12. The self-oiling portable bag-closing sewing machine of claim 11 wherein:

said needle driving assembly includes a pivot post rigidly fixed to said housing and extending within said drive train chamber;

said needle driving assembly further including a needle lever swingably mounted to said pivot post and said needle lever having an oil port confronting said main drive shaft and extending through said needle lever to pass oil through said needle lever and onto said pivot post;

said needle lever including an annular slot closely confronting said pivot post and communicating with said oil port in said needle lever to assure oil lubricating said pivot post.

13. The self-oiling portable bag-closing sewing machine of claim 12 wherein:

said needle lever includes an elongated section having a bearing aperture therein;

said needle driving assembly includes a needle bar clamp unit, said needle bar clamp unit having a longitudinal shaft with a central longitudinal axis and being slidably mounted within said bearing aperture of said needle lever, said longitudinal shaft of said needle bar clamp unit having a hollow axial passage therein and a radial oil port extending from said passage outwardly to communicate with said bearing aperture of said needle lever; and wicking means positioned within said drive train chamber and extending within said axial passage to said radial oil port to collect oil from within said drive train chamber and transfer it along said wicking means to said radial oil port for subsequent flow to said slidably mounted bar clamp longitudinal shaft and said needle lever bearing aperture.

14. The self-oiling portable bag-closing sewing machine of claim 13 wherein:

said needle driving assembly includes a needle drive shaft slidably mounted in said housing, carrying said needle and positioned below said needle bar clamp unit when said machine is in operating position.

said needle bar clamp unit further includes a clamp fixed to said needle drive shaft, said clamp including a pivot swingably mounted to said bar clamp longitudinal shaft; and said wicking means being attached to said pivot of said clamp to lubricate said pivot from oil on said wicking means and to encourage oil reaching said pivot to move downward by gravity flow onto said needle drive shaft to lubricate said shaft while the machine is in operating position.

15. The self-oiling portable bag-closing sewing machine of claim 10 wherein said eccentric collar has upper and lower surfaces and includes at least one oil bore extending between said upper and lower surfaces thereof to pass oil by gravity flow from the upper surface to the lower surface of said eccentric collar.

16. The self-oiling portable bag-closing sewing machine of claim 10 wherein said needle driving assembly includes:

a connecting rod rotatably receiving said eccentric collar therein so that movement of said collar is translated to reciprocating movement of said connecting rod; and an oil accumulation groove formed between said eccentric collar and said connecting rod to collect oil for gravity lubrication of said eccentric collar.

17. The self-oiling portable bag-closing sewing machine of claim 1 wherein said looper assembly includes a looper cam having upper and lower faces and being fixed to said main drive shaft for rotation with said drive shaft and to receive oil flowing downward from said lower end of said first main drive shaft bearing, said looper cam having a continuous cam follower slot in said lower face and at least one oil flow hole extending between said upper face and said continuous cam follower slot to direct oil from said upper face through said oil flow hole and into said cam follower slot to provide lubrication to said slot, said looper cam also distributing oil on said cam throughout said drive train chamber by flinging the oil radially outwardly in response to rotation of said looper cam by said main drive shaft so as to transfer oil within said chamber and to cause oil to be substantially fragmented into a multiplicity of fine droplets as a result of impact with said walls of said drive train chamber so as to create a fine mist of oil within said drive train chamber.

18. The self-oiling portable bag-closing sewing machine of claim 1 wherein:

a drive shaft oil accumulation trough is formed in said housing adjacent said second main drive shaft bearing to receive and accumulate oil flowing down said walls of said drive train chamber when the sewing machine is in its operating position; and said second main drive shaft bearing has an oil inlet port passing from the outer to the inner periphery of said second bearing and communicating with said oil accumulation trough to receive oil therefrom and direct it within said second main drive shaft bearing to lubricate said main drive shaft.

19. The self-oiling portable bag-closing sewing machine of claim 18 wherein:

said housing further includes a feed dog chamber positioned below said main drive train chamber when the sewing machine is in operating position;

said housing further includes a connecting aperture extending between said chambers; and said second main drive shaft bearing is retained in said aperture;

said main drive shaft extends into and terminates within said feed dog chamber; and channel means in said second main drive shaft bearing communicating with said oil inlet port in said second main drive shaft bearing and extending along the inner periphery of said second drive shaft bearing to the lower end of said second drive shaft bearing so that oil entering said channel means may flow through said second drive shaft bearing and into said feed dog chamber so as to lubricate said second main drive shaft bearing and to deliver oil within said feed dog chamber.

20. The self-oiling portable bag-closing sewing machine of claim 19 wherein:

a feed dog block having a top and bottom is mounted within said feed dog chamber and has a drive shaft aperture rotatably receiving said main drive shaft therein, said feed dog block being movably mounted to said housing for reciprocating movement along an elliptical path in response to rotation of said main drive shaft; and a feed dog block oil collection trough in said feed dog block and surrounding said drive shaft aperture to accumulate oil for lubrication of said main drive shaft and said feed dog block and for outward dispersion from said feed dog block oil collection trough during movement of said block along said elliptical path.

21. The self-oiling portable bag-closing sewing machine of claim 20 and further including a thread chain cutting device, said cutting device including:

a combined oil and motion transmitting member having a mounting segment fixed to said top of said feed dog block and an angled segment having front and rear surfaces and extending downwardly from said mounting segment when the machine is in operating position, said angled segment being positioned laterally of said feed dog block so that oil moved outwardly from said feed dog block oil collection trough during movement of said block along said elliptical path flows onto said mounting segment by centrifugal force and downwardly on said angled segment by gravitational force thereby providing a film of oil on said angled segment;

a stationary anvil on said housing;

a knife bracket including a knife thereon;

knife bracket pivot means fixed to said housing beneath said combined oil and motion transmitting member when the machine is in operating position and swingably mounting said knife bracket for swinging movement about a pivot axis and in an arc about said knife bracket pivot means so that said knife cooperates with said anvil while swinging through said arc so as to cut the thread;

said knife bracket including a bifurcated arm above said knife bracket pivot means and adjacent said angled segment and having a first bifurcation closely confronting the front surface of said angled segment and a second bifurcation closely confronting the rear surface of said angled segment so that back and forth movement in a first direction by said feed dog block during movement along said elliptical path causes said angled segment to move alternately against each said bifurcation so as to swing said knife bracket through said arc and movement of said feed dog block in a second direction substantially parallel to said pivot axis during movement along said elliptical path causes at least one of said bifurcations to scrape along said oil-covered angled segment to collect oil on said bifurcation, such collected oil flowing downwardly on said knife bracket to lubricate said knife bracket pivot means.

22. The self-oiling portable bag-closing sewing machine of claim 20 wherein:

said feed dog block includes a feed dog block bearing within said drive shaft aperture of said block, said feed dog block bearing having an inner periphery receiving and rotatably journaling said main drive shaft; and channel means on said inner periphery of said feed dog block bearing and communicating with said feed dog block oil-collection trough and terminating within said feed dog block bearing so that oil entering said channel means from said trough is inhibited from passing downwardly through said feed dog block bearing.

23. The self-oiling portable bag-closing sewing machine of claim 22 wherein said housing includes a perforated floor plate in said feed dog chamber to permit any excess oil buildup in said feed dog chamber to drain out of said chamber through said perforated floor plate so as to avoid oil buildup which might otherwise be deposited on the bag.

24. The self-oiling portable bag-closing sewing machine of claim 1 wherein:

said housing includes a looper shaft aperture extending between said drive train chamber and said feed dog chamber;

said looper assembly includes a looper shaft bearing positioned in said looper aperture and having an inner and outer periphery;

said looper assembly includes a looper shaft rotatably journaled in said looper shaft bearing;

a looper shaft oil accumulation trough is formed in said housing adjacent said looper shaft bearing to receive and accumulate oil flowing downwardly within said drive train chamber when the sewing machine is in its operating position;

said looper shaft bearing includes an oil port passing between said inner and outer periphery of said looper shaft bearing and communicating with said looper shaft oil accumulation trough so as to direct oil into and along said inner periphery of said looper shaft bearing.

25. The self-oiling portable bag-closing sewing machine of claim 24 and further including:

channel means on said inner periphery of said looper shaft bearing and communicating with said oil port to direct oil within said looper shaft bearing and along said looper shaft; and said channel means being wholly within said looper shaft bearing so that oil entering said channel means from said oil port is inhibited from passing downwardly through said looper shaft bearing.

26. The self-oiling portable bag-closing sewing machine of claim 1 wherein:

said drive train chamber includes at least one basin to which oil accumulating within said chamber moves by gravity flow;

said housing further includes a feed dog chamber positioned beneath said basin and said drive train chamber;

said main drive shaft extends into said feed dog chamber;

said feed dog assembly includes a feed dog block mounted to said main drive shaft and to said housing within said feed dog chamber for reciprocating movement along an elliptical path in response to rotation of said main drive shaft; and at least one weep hole in said housing and situated in said basin and above said feed dog assembly and extending between said drive train chamber and said feed dog chamber to permit oil accumulating in said basin to drain into said feed dog chamber and onto said reciprocating feed dog block so that impact by said moving block will cause such oil to be substantially fragmented into a multiplicity of fine droplets so as to create a mist of oil within said feed dog chamber.

27. The self-oiling portable bag-closing sewing machine of claim 1 wherein said assembly onto which oil is directed is said needle driving assembly.

28. The self-oiling portable bag-closing sewing machine of claim 27 wherein said needle driving assembly includes a collar fixed to said main drive shaft for rotation with said shaft so that said collar is capable of receiving oil from said oil delivery means and dispensing said oil through said drive train chamber by radially directed outward flinging of the oil during main drive shaft rotation.

29. The self-oiling portable bag-closing sewing machine of claim 1 wherein said assembly onto which oil is directed is said looper assembly.

30. The self-oiling portable bag-closing sewing machine of claim 29 wherein said looper assembly includes a looper cam fixed to said main drive shaft for rotation with said shaft, said looper cam positioned to receive oil by gravity flow from said lower end of said first drive shaft bearing and capable of dispersing oil throughout said drive train chamber by outward flinging of said oil during rotation of said looper cam with said main drive shaft.

31. The self-oiling portable bag-closing sewing machine of claim 1 wherein said assembly onto which oil is directed is said feed dog assembly.

32. The self-oiling portable bag-closing sewing machine of claim 1 wherein said assemblies onto which oil is directed include said needle driving assembly and said looper assembly.

33. A self-oiling portable bag closing sewing machine energizeable from a power source and capable of using thread to stitch a bag closed comprising:

a housing having an internal drive train chamber defined by chamber walls and said housing including a handle for carrying the machine;

driving means selectively connectable to the power source, carried by said housing, and including a motor and a main drive shaft rotatably mounted for rotation about the longitudinal axis of said main drive shaft, and said main drive shaft extending within said drive train chamber and being drivingly connected with said motor to rotate said main drive shaft when the motor is energized;

a needle driving assembly including a needle having a longitudinal axis, said needle driving assembly being operatively movingly connected with said driving means to move said needle along said longitudinal axis of said needle in reciprocating movement in response to energizing of said driving means;

a feed dog assembly carried by said housing and operatively connected to said driving means to actuate said feed dog assembly for cooperation with said needle driving assembly in response to energizing of said driving means:

a presser foot unit carried by said housing and selectively bearing against said feed dog assembly and cooperating with said feed dog assembly to urge the bag against said feed dog assembly and thereby assist in moving the bag along a path past the needle;

a looper assembly carried by said housing and operatively connected with said driving means, said looper assembly cooperating with said reciprocating needle to form a stitch with thread so as to cause the bag to be stitched closed as the bag moves along the path;

an oil reservoir capable of storing the oil and carried by said housing;

oil delivery means connected in fluid-flow relation with said oil reservoir and with said housing to direct oil to said drive train chamber and onto at least one of said assemblies for dispersion within said drive train chamber by outward flinging of such oil within said chamber by at least one of said assemblies during operation of the sewing machine.

* * * * *